US011661246B2

(12) United States Patent
Sill et al.

(10) Patent No.: US 11,661,246 B2
(45) Date of Patent: May 30, 2023

(54) CARTON WITH REMOVABLE LID

(71) Applicant: Inno-Pak, LLC, Delaware, OH (US)

(72) Inventors: Jonathan D. Sill, Delaware, OH (US); Steven A. Mayer, Indianapolis, IN (US); Christopher J. Shepardson, Kingwood, TX (US); Edward Von Doersten, Austin, TX (US)

(73) Assignee: Inno-Pak, LLC, Delaware, OH (US)

( * ) Notice: Subject to any disclaimer, the term of this patent is extended or adjusted under 35 U.S.C. 154(b) by 857 days.

(21) Appl. No.: 16/691,891

(22) Filed: Nov. 22, 2019

(65) Prior Publication Data

US 2020/0189806 A1 Jun. 18, 2020

Related U.S. Application Data

(60) Provisional application No. 62/779,807, filed on Dec. 14, 2018.

(51) Int. Cl.
*B65D 43/02* (2006.01)
*B65D 5/24* (2006.01)
(Continued)

(52) U.S. Cl.
CPC ..... *B65D 43/0202* (2013.01); *B65D 5/241* (2013.01); *B65D 5/305* (2013.01);
(Continued)

(58) Field of Classification Search
CPC ..... B65D 5/2057; B65D 5/24; B65D 5/28; B65D 5/4279; B65D 5/667;
(Continued)

(56) References Cited

U.S. PATENT DOCUMENTS

D73,127 S 7/1927 Greve
2,019,870 A 11/1935 Perry
(Continued)

FOREIGN PATENT DOCUMENTS

GB 2088269 A 11/1999

OTHER PUBLICATIONS

"Bowl Sleeve", The Custom Packaging Boxes, Available from internet, https://thecustompackagingboxes.com/boxes-by-style/bowl-sleeve/, 2018, 04 pages.
(Continued)

*Primary Examiner* — Christopher R Demeree
(74) *Attorney, Agent, or Firm* — Ward and Smith, P.A.; Ryan K. Simmons

(57) ABSTRACT

A carton with a removable lid, the carton may include a floor panel; a plurality of side panels extending about a periphery of the bottom panel. The one or more of the side panels may include one or more tabs extending from an upper edge thereof. The carton may further include foldable corner gussets extending between adjacent side panels. The bottom panel, side panels, and foldable corner gussets may be configurable to form a compartment region; and a removable lid. The removable lid may include a lid panel and one or more slots formed in the lid panel, wherein the lid panel may be configured to cover the compartment region, and wherein the one or more slots may be sized, shaped, and positioned such that when the removable lid is installed atop the compartment region, the one or more tabs align with the one or more slots and are received therethrough.

24 Claims, 28 Drawing Sheets

(51) Int. Cl.
*B65D 5/30* (2006.01)
*B65D 5/56* (2006.01)
*B65D 5/64* (2006.01)
*B65D 5/32* (2006.01)

(52) U.S. Cl.
CPC ..... *B65D 5/321* (2013.01); *B65D 5/56* (2013.01); *B65D 5/64* (2013.01); *B65D 2543/00833* (2013.01)

(58) Field of Classification Search
CPC .. B65D 2525/285; B65D 43/02; B65D 5/244; B65D 5/6614; B65D 5/6652; B65D 81/3216; B65D 43/0202; B65D 5/241; B65D 5/305; B65D 5/321; B65D 5/56; B65D 5/64; B65D 2543/00833; B65D 5/2047; B31B 2105/0024; B31B 2105/50734; B31B 50/0044; B31B 50/73
USPC ..... 229/114, 148, 125.29, 125.19, 125.01; D9/431; 206/557
See application file for complete search history.

(56) References Cited

U.S. PATENT DOCUMENTS 2,062,949 A 12/1936 Taylor
D106,826 S 11/1937 Dieffenbach
D126,123 S 3/1941 Clemens
2,341,762 A 2/1944 Conklin
2,355,729 A 8/1944 Inman
2,409,736 A 10/1946 Caimi
2,475,294 A 7/1949 Rafoth
D158,362 S 5/1950 Dischler
2,568,170 A 9/1951 Ringler
2,786,572 A 3/1957 Gentry
2,793,801 A 5/1957 Papadopoulos
D183,716 S 10/1958 James
2,927,502 A 3/1960 Watrous
3,027,063 A 3/1962 Zastrow
D194,246 S 12/1962 Engelmann
D200,249 S 2/1965 Hancock
3,367,557 A 2/1968 Farquhar
D211,564 S 7/1968 Bailey
3,391,816 A 7/1968 Swett
D212,495 S 10/1968 Stageberg
3,443,681 A 5/1969 Wysocki
D214,523 S 6/1969 Stone et al.
D217,441 S 5/1970 Kanaga
D219,263 S 11/1970 Castelli et al.
3,595,425 A 7/1971 Eicholtz et al.
3,604,614 A 9/1971 Sternfeld
3,640,380 A 2/1972 Huffman
D224,090 S 7/1972 Cyr et al.
3,701,181 A 10/1972 Lock
D232,302 S 8/1974 Lazure
D232,524 S 8/1974 Schy
3,853,220 A 12/1974 Luray
D241,016 S 8/1976 Reynold
4,156,956 A * 6/1979 Partridge ..... A61G 17/044 27/4
D255,011 S 5/1980 Cooper et al.
D259,615 S 6/1981 Morris, Jr.
D260,604 S 9/1981 Otto
4,470,538 A * 9/1984 Heathcock ..... B65D 5/6697 229/125.08
D276,137 S 10/1984 Vere et al.
4,529,464 A 7/1985 Jones
D280,290 S 8/1985 Bakus
4,596,356 A 6/1986 Chaussadas
4,844,328 A 7/1989 Cooper
4,846,398 A 7/1989 Johnson
4,856,707 A * 8/1989 Lorenz ..... B65D 5/64 229/199
4,960,238 A * 10/1990 Lorenz ..... B65D 5/28 229/114
D329,376 S 9/1992 Burd
5,226,588 A 7/1993 Schramm et al.
5,322,182 A 6/1994 Fritz
D351,997 S 11/1994 Finnah
D352,203 S 11/1994 Campbell et al.
5,411,204 A 5/1995 DeMay
5,419,451 A 5/1995 Bitel, Jr.
D363,192 S 10/1995 Reeves et al.
D363,856 S 11/1995 Westbrooks, Jr.
5,484,059 A 1/1996 Sutherland
D367,172 S 2/1996 Brightbill et al.
D371,940 S 7/1996 Krupa
D372,170 S 7/1996 Ahern, Jr.
D376,953 S 12/1996 Dunn
D394,385 S 5/1998 Laughlin
D395,547 S 6/1998 Sussman
5,765,685 A 6/1998 Roosa
D397,294 S 8/1998 Saulas
D398,526 S 9/1998 Schwarz et al.
5,855,275 A 1/1999 Hunter et al.
5,873,220 A 2/1999 Haraldsson et al.
D409,908 S 5/1999 Besana
5,927,502 A 7/1999 Hunter
D412,398 S 8/1999 Watabe
D440,118 S 4/2001 Claffy et al.
D442,859 S 5/2001 Hirschey
D444,703 S 7/2001 Allasia
D445,311 S 7/2001 Emonet et al.
D448,130 S 9/2001 Wagner
D451,769 S 12/2001 Stanos et al.
D454,495 S 3/2002 Bryan et al.
D460,689 S 7/2002 Robinson
D461,406 S 8/2002 Iacovelli
D467,798 S 12/2002 Cohon
6,612,482 B2 9/2003 Ross
D484,364 S 12/2003 Bailey et al.
D484,799 S 1/2004 Hoffman et al.
D495,251 S 8/2004 Zack
D497,309 S 10/2004 Nordland et al.
D500,674 S 1/2005 Chou
D504,813 S 5/2005 Chou
D509,733 S 9/2005 Jongens
D512,836 S 12/2005 Marnell, II
7,004,314 B2 2/2006 Pucillo et al.
D519,366 S 4/2006 Epstein
D519,830 S 5/2006 Yocum
D521,376 S 5/2006 Mosto
D521,862 S 5/2006 Siethoff et al.
D531,498 S 11/2006 Fluegel et al.
D542,129 S 5/2007 Moorman
D549,456 S 8/2007 Dretzka
D549,457 S 8/2007 Dretzka
D557,047 S 12/2007 Dretzka
D561,023 S 2/2008 Jacxsens
D561,408 S 2/2008 Marsh
D562,125 S 2/2008 Kienemund-Paroll
D563,673 S 3/2008 Dretzka
D567,671 S 4/2008 Say Ulin
D568,765 S 5/2008 Miles
D573,408 S 7/2008 Lovett
D573,409 S 7/2008 Lovett
D576,482 S 9/2008 DeBusk
D578,387 S 10/2008 Lovett
D582,268 S 12/2008 Zanaletti
D582,791 S 12/2008 Elmerhaus
D584,108 S 1/2009 Olsson
D590,596 S 4/2009 Dretzka
D595,155 S 6/2009 Larson
D596,027 S 7/2009 Kalberer
D596,448 S 7/2009 Nolan
D596,449 S 7/2009 Nolan
D596,903 S 7/2009 Willis et al.
7,565,997 B1 7/2009 Lim
D599,611 S 9/2009 Hoekstra
D605,896 S 12/2009 Zalewski et al.
D608,153 S 1/2010 Furlong
D615,822 S 5/2010 Klein
D622,139 S 8/2010 Marcott et al.
D630,508 S 1/2011 Hubbard, Jr. et al.

(56) References Cited

U.S. PATENT DOCUMENTS

D630,885 S 1/2011 Stein
D631,741 S 2/2011 Hubbard, Jr. et al.
D631,742 S 2/2011 Hubbard et al.
D631,743 S 2/2011 Hubbard, Jr. et al.
D633,341 S 3/2011 Smyers
D635,469 S 4/2011 Buitrago
D641,256 S 7/2011 Fisher
D642,934 S 8/2011 Ly
D643,311 S 8/2011 Meyers
D645,708 S 9/2011 Stamper et al.
8,061,585 B2 11/2011 Nikolai et al.
D649,838 S 12/2011 Stamper et al.
D652,316 S 1/2012 Ren et al.
D653,496 S 2/2012 Henry
D657,261 S 4/2012 de Gast
D665,271 S 8/2012 Halty et al.
D665,628 S 8/2012 Mayer
D669,352 S 10/2012 Paslawski
D674,690 S 1/2013 Sill
D675,092 S 1/2013 Sill
D675,520 S 2/2013 Sill
D675,920 S 2/2013 Sill
D676,742 S 2/2013 Walter et al.
D678,760 S 3/2013 Cooper
D678,761 S 3/2013 Cooper
D678,762 S 3/2013 Cooper
D678,779 S 3/2013 Lee
D679,950 S 4/2013 Cooper
D682,085 S 5/2013 Hannant et al.
D682,684 S 5/2013 Walter et al.
D684,465 S 6/2013 Vernon et al.
D684,858 S 6/2013 Sill
D688,552 S 8/2013 Vernon et al.
D688,572 S 8/2013 Marin
D688,921 S 9/2013 Miros et al.
D691,035 S 10/2013 Sill
D693,180 S 11/2013 Peterson et al.
D693,215 S 11/2013 Sill
D693,216 S 11/2013 Sill
D693,217 S 11/2013 Sill
D693,218 S 11/2013 Sill
D693,646 S 11/2013 Katterheinrich et al.
D693,679 S 11/2013 Sill
D695,101 S 12/2013 Keberlein et al.
D695,104 S 12/2013 Sill
D695,107 S 12/2013 Clements
D695,575 S 12/2013 Katz
D695,605 S 12/2013 Johnson
D697,789 S 1/2014 Gerdes et al.
D706,132 S 6/2014 Sill
D707,042 S 6/2014 Ruzzenente
D707,123 S 6/2014 Marchetti et al.
D710,691 S 8/2014 Genender
D712,153 S 9/2014 Lee
D714,638 S 10/2014 Mohn et al.
D718,641 S 12/2014 Ryan et al.
8,939,350 B2 1/2015 Valencia
D726,533 S 4/2015 Northrup
D727,724 S 4/2015 Pipes et al.
D727,732 S 4/2015 Petty
D728,359 S 5/2015 Iwegbu
D728,364 S 5/2015 Baker et al.
D730,178 S 5/2015 Fullan
D731,325 S 6/2015 Loessin
D735,576 S 8/2015 Aldridge
D737,820 S 9/2015 Yu et al.
D742,759 S 11/2015 Ryan et al.
9,211,970 B2 12/2015 Hubbard, Jr. et al.
9,212,842 B2 12/2015 Vasbinder et al.
9,216,837 B2 12/2015 Hubbard et al.
D746,643 S 1/2016 Kraemer
D746,671 S 1/2016 Fohner et al.
D752,429 S 3/2016 Mayer
9,309,023 B2 4/2016 Hubbard, Jr. et al.
D758,184 S 6/2016 Tu et al.
D760,036 S 6/2016 Hucuptan
D763,706 S 8/2016 Shum et al.
D764,276 S 8/2016 Das et al.
D764,281 S 8/2016 Mayer
D766,664 S 9/2016 Wilson et al.
D767,409 S 9/2016 Nickell
D769,732 S 10/2016 Shoshan
D770,270 S 11/2016 McGarry et al.
D771,486 S 11/2016 Mayer
D772,053 S 11/2016 Mayer
D775,946 S 1/2017 Ghini et al.
D776,548 S 1/2017 Bell
D777,029 S 1/2017 Stratton
D778,115 S 2/2017 Strachan
D778,155 S 2/2017 Strachan
D778,722 S 2/2017 Strachan
D784,769 S 4/2017 Beckman et al.
D786,621 S 5/2017 Davis
D792,160 S 7/2017 Ng
D792,161 S 7/2017 Ng
D792,211 S 7/2017 Foster et al.
D792,222 S 7/2017 Sill et al.
D792,761 S 7/2017 Duval et al.
D793,868 S 8/2017 Kim et al.
D798,707 S 10/2017 Mayer
D798,736 S 10/2017 Shoshan
D809,849 S 2/2018 Lee
D809,930 S 2/2018 Kagawa
D809,931 S 2/2018 Kagawa
D814,929 S 4/2018 Bergeron et al.
D815,941 S 4/2018 Haddad
D815,955 S 4/2018 Park et al.
10,017,290 B2 7/2018 Faulkner et al.
D828,099 S 9/2018 Zhang
D828,157 S 9/2018 Paradis
D828,766 S 9/2018 Latour et al.
D829,563 S 10/2018 Park et al.
D830,193 S 10/2018 Park et al.
D830,852 S 10/2018 Sill et al.
D836,449 S 12/2018 Park et al.
10,167,134 B2 1/2019 Zeitlin et al.
D840,232 S 2/2019 Sill et al.
D849,553 S 5/2019 Song et al.
D850,932 S 6/2019 Troudt et al.
D850,933 S 6/2019 Troudt et al.
D854,942 S 7/2019 Requena et al.
D854,943 S 7/2019 Requena et al.
D858,270 S 9/2019 Requena et al.
D869,289 S 12/2019 Sill et al.
D875,530 S 2/2020 Sill et al.
D876,951 S 3/2020 Sill et al.
2002/0108955 A1 8/2002 Erb
2003/0217946 A1 11/2003 Hsu
2004/0182916 A1 9/2004 Roseth
2005/0051461 A1 3/2005 Bryant
2005/0124521 A1 6/2005 Sadlowski et al.
2005/0150788 A1 7/2005 Feusner
2007/0074993 A1 4/2007 Philips
2007/0178194 A1 8/2007 Everard
2008/0269034 A1 10/2008 Stier
2009/0039144 A1* 2/2009 Hooi ..... B65D 5/248
229/148
2009/0186132 A1 7/2009 Mangino et al.
2010/0065620 A1 3/2010 Smith
2011/0240653 A1 10/2011 Castner et al.
2012/0234904 A1 9/2012 Costanzo, Jr.
2013/0341386 A1* 12/2013 Hubbard, Jr. ..... B65D 5/2057
229/150
2014/0203070 A1 7/2014 Lee
2014/0263353 A1 9/2014 Bell
2014/0263600 A1 9/2014 Valencia
2016/0107830 A1 4/2016 Baryshyan
2018/0339807 A1 11/2018 Mobarhan
2019/0322409 A1 10/2019 Sill et al.

OTHER PUBLICATIONS

"Food packaging sleeves", Ostle & Maillard, 2019, 01 page.

(56) References Cited

OTHER PUBLICATIONS

Alibaba, "Black Disposable Divided Food Trays", Available from Internet, URL:https://thai.alibaba.com/product-detail/Airline-disposable-plastic-four-compartment-CPET-1238104653.html, Accessed on Apr. 3, 2017, Oct. 1, 2013, 9 pages.
Alibaba, "Disposable Plastic Two Compartment Food Container", https://www.alibaba.com/product-detail/disposable-plastic-two-compartment-food-container_60599614850.html, 2018, 8 pages.
Amazon, "Dart 205HT2, 9x6x3-Inch Performer White Two Compartment Foam Container with a Removable Hinged Lid, Carryout Food Disposable Containers", Available from internet, https://www.webstaurantstore.com/cambro-9113cw414-camwear-teal-9-x-11-3-compartment-meal-delivery-tray-case/2149113CWTE.html,. Sep. 12, 2016, 6 pages.
Amazon, "Food Containers 3 Compartment Premium", Available from internet, URL:https://www.amazon.com/dp/B0741BQMY7/ref=sspa_dk_detail_2?psc=1%20&pd_rd_i=B0741BQMY7&pd_rd_wg=gDStp%20&pd_rd_r=ACEV1YJAC97ZZPCCXWCW&pd_rd_w=XZKtg, Jul. 18, 2017, 9 pages.
Amazon, "Freshware Meal Prep Containers [30 Pack] 3 Compartment with Lids, Food Storage Containers, Bento Box | BPA Free | Stackable Microwave/Dishwasher/Freezer Safe (32 oz)", Feb. 13, 2019, 9 pages.
Amazon, "Pactiv RCL750200, 3-Compartment Aluminum Foil Pans Combo with Flat Foil Lids, Take Out Disposable Foil Containers with Matching Covers", Available at https://www.amazon.com/Pactiv-RCL750200-3-Compartment-Disposable-Containers/dp/801LXOJ7BP/ref=sr_1_1?keywords=Pactiv+RCL750200&gid-1572606252&sr=8-1, Sep. 28, 2016, 5 pages.
Amazon, "Southern Champion Tray 0731 #1 ChampPak Classic Take-Out Container, Kraft Paperboard Coated Inside", Southern Champion Tray, Jan. 17, 2013, 1 page.
Amazon, "Southern Champion Tray 23133K Kraft Paperboard Lock Corner Window Bakery Box", Southern Champion Tray, Mar. 15, 2013, 1 page.
Amazon, "50 Paper Food to Go Containers—51 oz—New Design with Waist Seal Band—Eco Friendly Disposable Kraft Paper Take Out Food Container—Sturdy Leak & Grease Proof Microwavable Take Away Boxes", Available from internet, https://www.amazon.com/Paper-Food-Containers-Disposable-Microwavable/dp/807M74VWXW, Nov. 5, 2019, 6 pages.
Blair Candy, "Empty Candy Boxes", Available from internet, https://www.blaircandy.com/emcabo.html, 2013, 1 page.
Dean Supply, "Disposable Takeout Containers", Jul. 18, 2017, 9 pages.
Flex Active Sports, "Buy 3-Compartment Food Prep Containers", Available from Internet, URL:http://flexactivesports.com/buy-3-compartment-food-prep-containers/, Jan. 5, 2016, 14 pages.
Glynn, Robin, "Origami Treasure Chest", Available from internet https://www.youtube.com/watch?v=WpgGqeBQvj4, Nov. 29, 2010, 1 page.
Importitall, "Southern Champion Tray 0761 #1", ChampPak Retro Take-Out, Jul. 13, 2017, 1 page.
Importitall, "Southern Champion Tray 0764 #4", ChampPak Retro Take-Out, Jul. 13, 2017, 1 page.
Inno-Pak, "Innobox Edge Insert", Oct. 25, 2016, 3 pages.
Jcpak, "Cardboard Sleeves for Food Tray", Cartons and Boxes, Available from Internet, http://www.jchengpackage.com/Cartons_and_Boxes/28.htmi, 2018, 02 pages.
Kalifornia Love, "Extra Fruit Sensations Sweet Watermelon", Available from Internet, http://www.kalifornialove.com/2010/07/extra-fruit-sensations-sweet-watermelon.html, Jul. 28, 2010, 20 pages.
Nearof, "Review: Stride Spark Vitamin Chewing Gum", Available from Internet, http://www.nearof.com/review-stride-spark-vitamin-chewing-gum/, Sep. 7, 2011, 4 pages.
Placon, "Fresh n Clear Go Cubes Black Insert Tray", https://www.placon.com/products/stock-food-package/fresh-n-clear-gocubes-black-insert-tray/>, 2016, 2 pages.
Robives, "Curved Lid Box", Nov. 2, 2013, 1 page.
Shutterstock, "Empty Food Tray Sleeve Packaging with Handles and Blueprint Template", Available from Internet, https://www.shutterstock.com/image-illustration/empty-food-tray-sleeve-packaging-handles-288654425?rid=928534, 08 pages.
Splash Packaging, "Natural Kraft Windowed Boxes", Available from Internet, https://www.splashpackaging.com/window-bakery-boxes-kraft.html, Oct. 4, 2014, 1 page.
The Delaware Gazette, "Inno-Pak is Staying Put", Available from Internet, https://www.delgazette.com/news/295/inno-pak-is-staying-put, accessed on Dec. 11, 2015, Jun. 13, 2015, 1 page.
The Dumbbelle, "Fitness Meal Prep Containers for Healthy Living", Available from Internet, https://thedumbbelle.com/fitness-meal-prep-containers/. Accessed on May 3, 2019, 9 pages.
Webstaurant Store, "Cambro 9113CW414 Camwear Teal 9" x 11" 3 Compartment Meal Delivery Tray", Available from Internet, <URL : https://www.webstaurantstore.com/cambro-9113cw414-camwear-teal-9-x-11-3-compartment-meal-delivery-tray-case/2149113CWTE.html, Mar. 14, 2010, 4 pages.
Webstaurant Store, "Cambro 9113CW414 Camwear Teal 9" x 11" 3 Compartment Meal Delivery Tray", Available from Internet, https://www.webstaurantstore.com/cambro-9113cw414-camwear-teal-9-x-11-3-compartment-meal-delivery-tray-case/2149113CWTE.html, Mar. 14, 2010, 4 pages.
Webstaurantstore.com, "Choice 7 3/4" x 5 1/2" x 2" Kraft Microwavable Folded Paper #2 Take-Out Container—200/Case", Available from Internet, https://www.webstaurantstore.com/choice-8-1-2-x-6-x-2-kraft-microwavable-folded-paper-2-take-out-container-case/795PTOKFT2.html, 6 pages.
Westrock, "Fold-Pak—Bio-Plus Earth", Available from Internet, http://www.fold-pak.com/products/Bio-PiusEarth.htm, Nov. 5, 2019, 2 pages.
Youtube, "Inno-Pak Rigid Microwavable Take Out Containers", Available from Internet, URL:https://www.youtube.com/watch?v=WoIGFg_sHSk, Sep. 17, 2014, 1 page.

* cited by examiner

CARTON WITH REMOVABLE LID

RELATED APPLICATIONS

This application claims priority and is related to U.S. Provisional Patent Application Ser. No. 62/779,807 entitled "Carton with Removable Lid," filed Dec. 14, 2018, the contents of which are incorporated herein by reference in its entirety.

TECHNICAL FIELD

The presently disclosed subject matter relates generally to cartons and more particularly to a food cartons with a removable lid.

BACKGROUND

Various products are known to be purchased by consumers which require a carton for ease of transport. For example, in the food and grocery industry it is common to place food items in individual carry-out food cartons. There may be certain drawbacks to commonly used carry-out food cartons. For example, often the cover or lid may be fastened to the carton body in a hinged fashion. If a user wishes to eat directly out of the carry-out food carton, the lid is swung open and, still attached, can be awkwardly in the way. Further, often carry-out food cartons are not designed for reliable stacking.

SUMMARY OF THE INVENTION

Some embodiments of the inventive subject matter provide a carton with a removable lid, the carton may include a floor panel; side panels extending about a periphery of the bottom panel. The one or more of the side panels may include one or more tabs extending from an upper edge thereof. The carton may further include foldable corner gussets extending between adjacent side panels. The floor panel, side panels, and foldable corner gussets may be configurable to form a compartment region; and a removable lid. The removable lid may include a lid panel; and one or more slots formed in the lid panel, wherein the lid panel may be configured to cover the compartment region, and wherein the one or more slots may be sized, shaped, and positioned such that when the removable lid is installed atop the compartment region, the one or more tabs align with the one or more slots and are received therethrough. The side panels may include two opposing end panels and two opposing side panels, wherein adjacent side panels and end panels may be coupled together via foldable corner gussets. Each of the opposing end panels or each of the opposing side panels may include one of the one or more tabs. Each of the opposing end panels and each of the opposing side panels may include one of the one or more tabs. The one or more tabs may include locking indents formed at their base, wherein when the removable lid is installed atop the compartment region the locking indents may be configured to engage with the one or more slots to hold the removable lid in place. The removable lid may include one or more side wings formed on one or more side edges of the lid panel. The one or more side wings may be formed on the one or more side edges of the lid panel that do not comprise one of the one or more slots. One or more of the side panels may further include a side flap formed therein. The side panels that do not include one of the one or more tabs may include the side flap. The lid panel may include two opposing side edges and two opposing end edges, wherein the one or more slots are formed proximate to the opposing end edges and the one or more side wings are formed at the opposing side edges. The lid panel may include one slot formed proximate to each of the opposing end edges and one side wing formed at each of the opposing side edges. The one or more side wings each may include a locking mechanism, wherein the locking mechanism may be configured to engage with a corresponding side flap formed on a corresponding one of the side panels when the removable lid is installed atop the compartment region. The one or more tabs may be spaced and configured such that when the removable lid is installed atop the compartment region a bottom surface of a compartment region of a second carton can nestle between the one or more tabs such that the bottom surface of the compartment region of the second carton sits substantially flat atop a top surface of the removable lid. The removable lid may include one or more side flaps formed on one or more side edges of the lid panel. The one or more of the side panels may further include a side flap. The one or more side flaps of the side panels each may include a locking mechanism formed therein, wherein the locking mechanism may be configured to engage with a portion of a corresponding side flap of the lid panel when the removable lid is installed atop the compartment region. The foldable corner gussets each may include a first and an adjacent second side portion, wherein the first side portion and the second side portions intersect at a fold line therebetween. The foldable corner gussets may be configured to be folded inward along their respective fold lines such that exterior facing surfaces of adjacent first and second side portions are in contact with one another. The inward folded foldable corner gussets may be configured to be further folded such that an interior facing surface of one of the first or second side portions is in contact with an interior surface of its corresponding adjacent side panel. The carton may further include an adhesive, wherein the adhesive holds the exterior facing surfaces of the adjacent first and second side portions in contact with one another. The first side portion and the second side portion may be substantially the same size and shape. The one of the first side portion or the second side portion may be shorter than the other. The inward folded foldable corner gussets may be configured to be further folded such that an interior facing surface of the shorter one of the first or second side portions is in contact with an interior surface of its corresponding adjacent side panel. The interior surface of the compartment region may include a heat sealable coating, and wherein the foldable corner gussets may be secured in its fully folded configuration by activating the heat sealable coating using a heat sources. The interior surface of the compartment region may include a heat sealable coating.

BRIEF DESCRIPTION OF THE DRAWINGS

Figure 1:
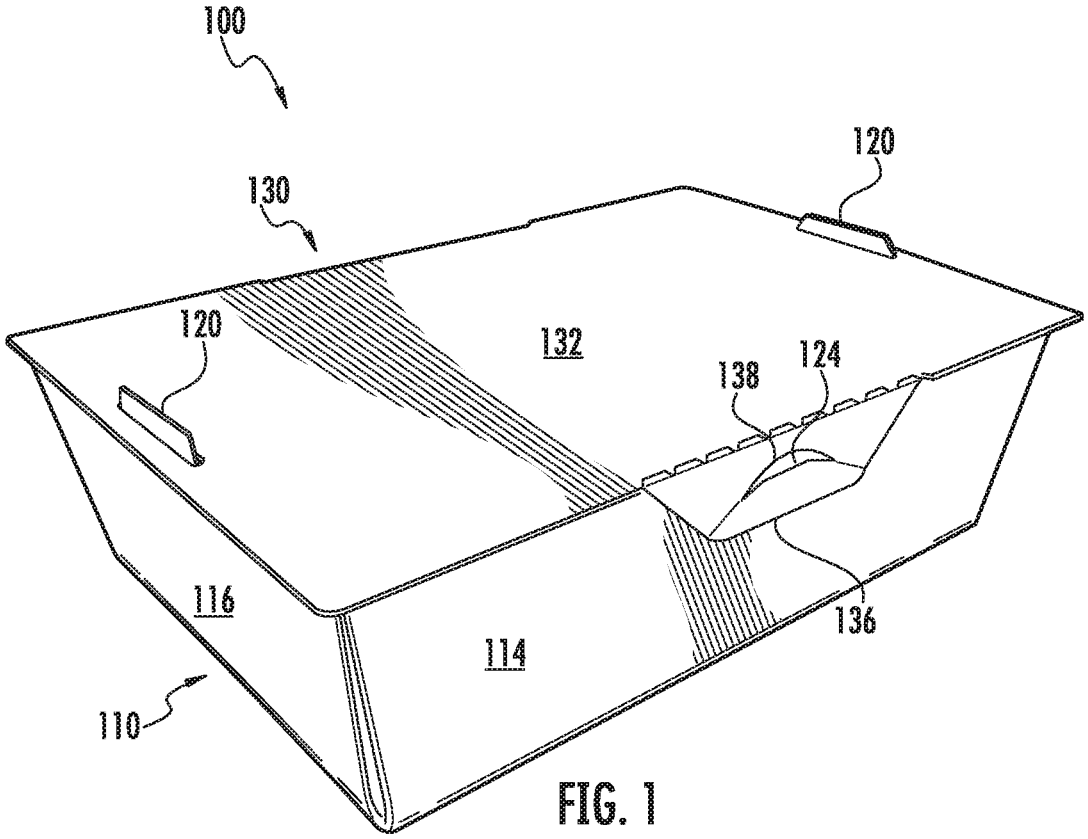
Figure 2:
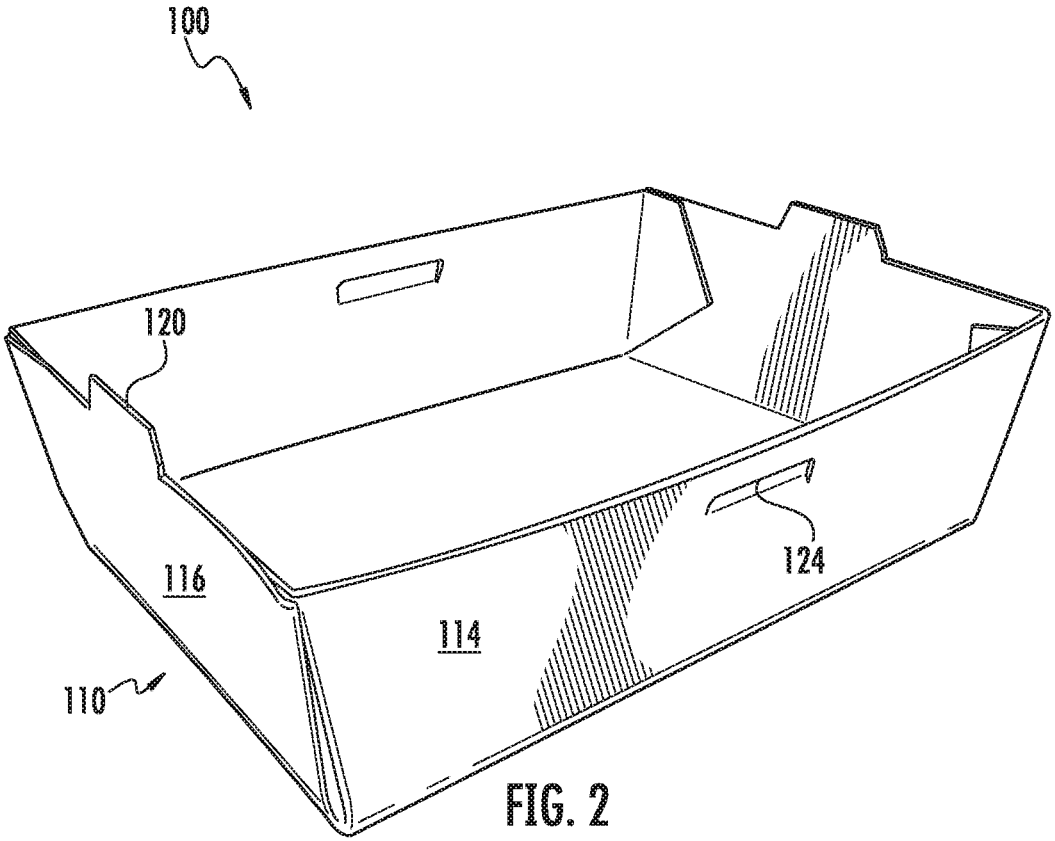
Figure 3:
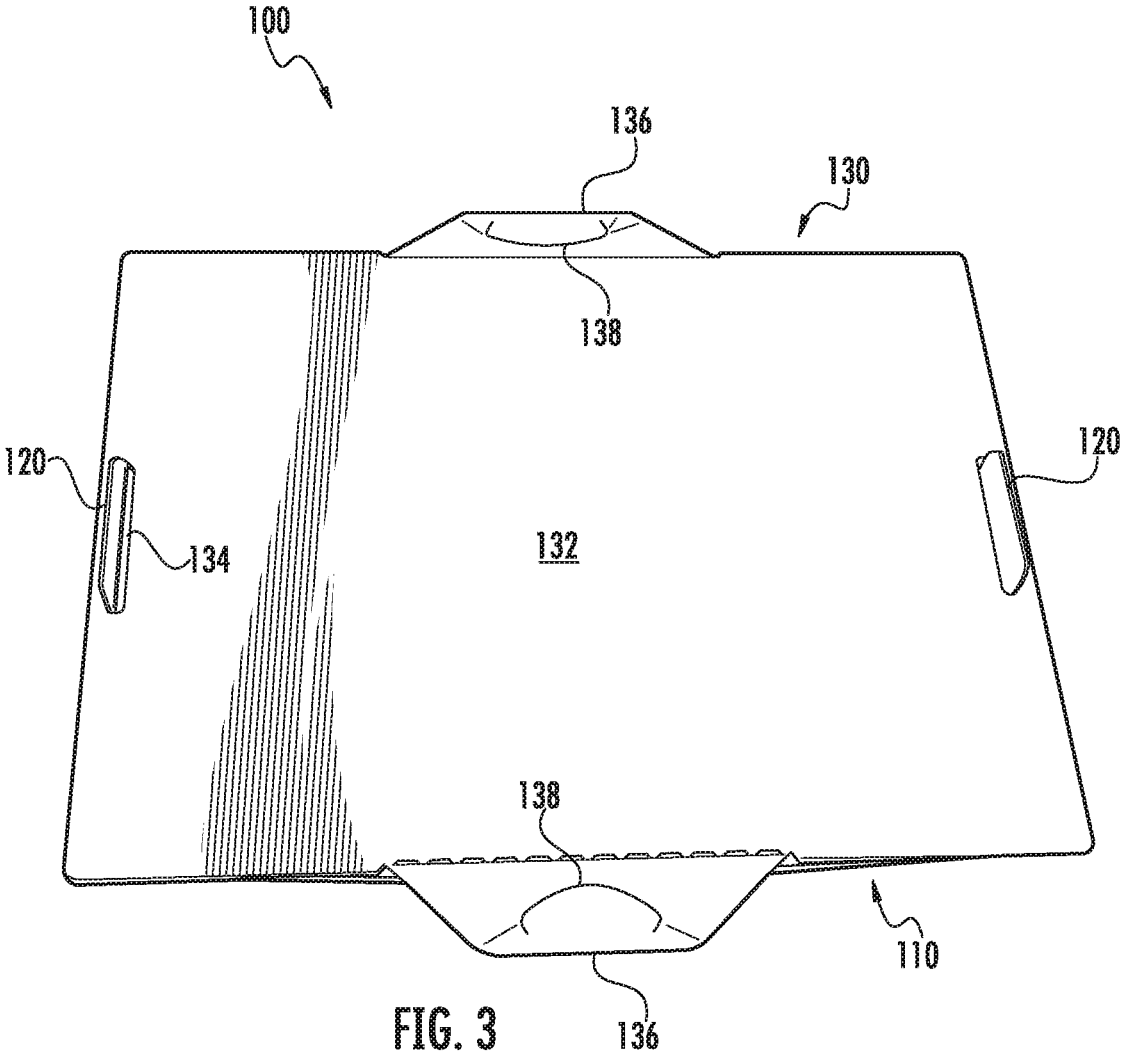
Figure 4:
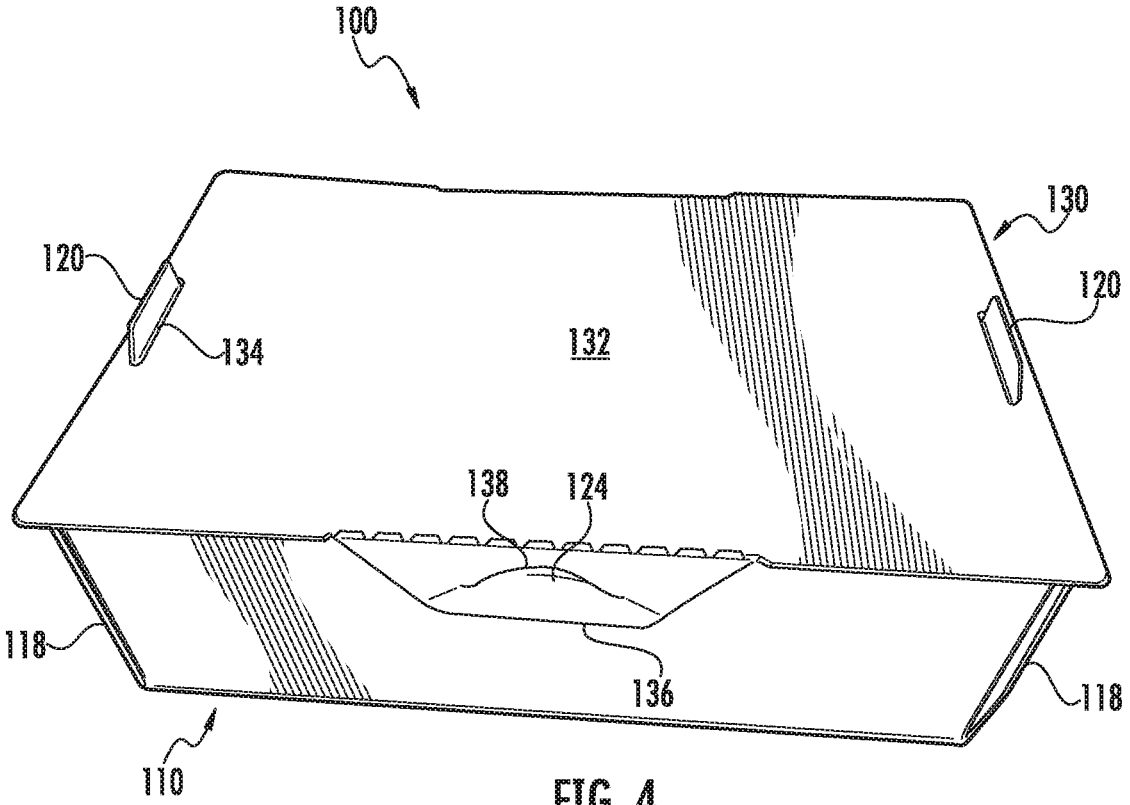
Figure 5:
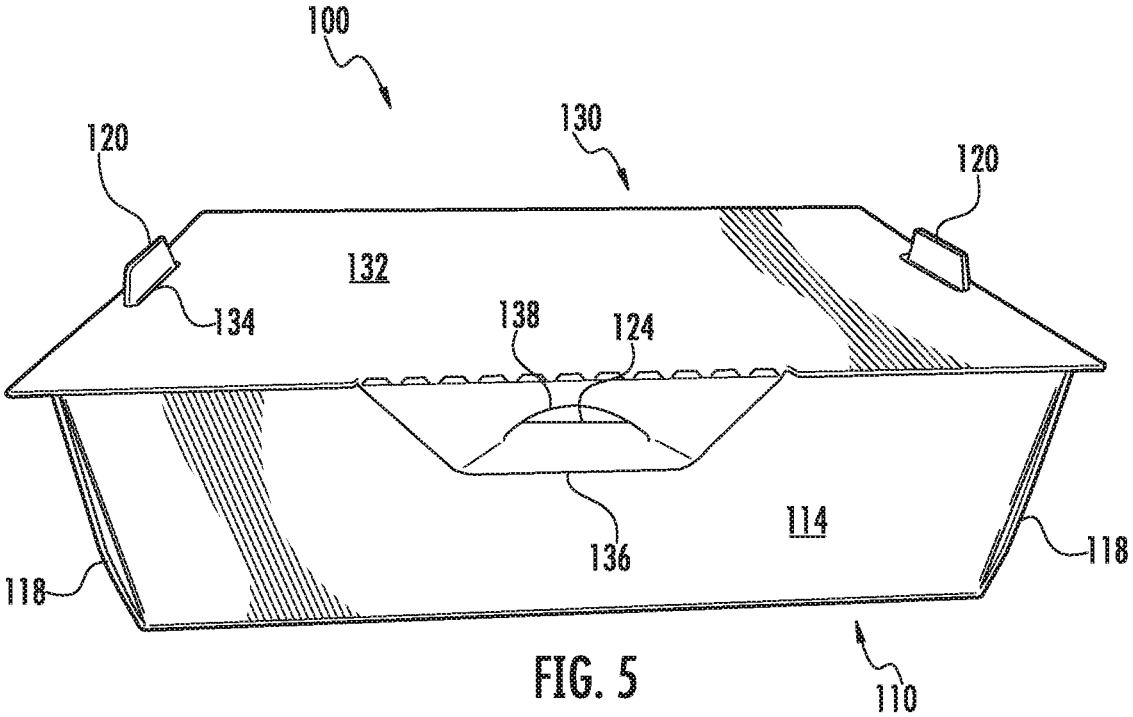
Figure 6:
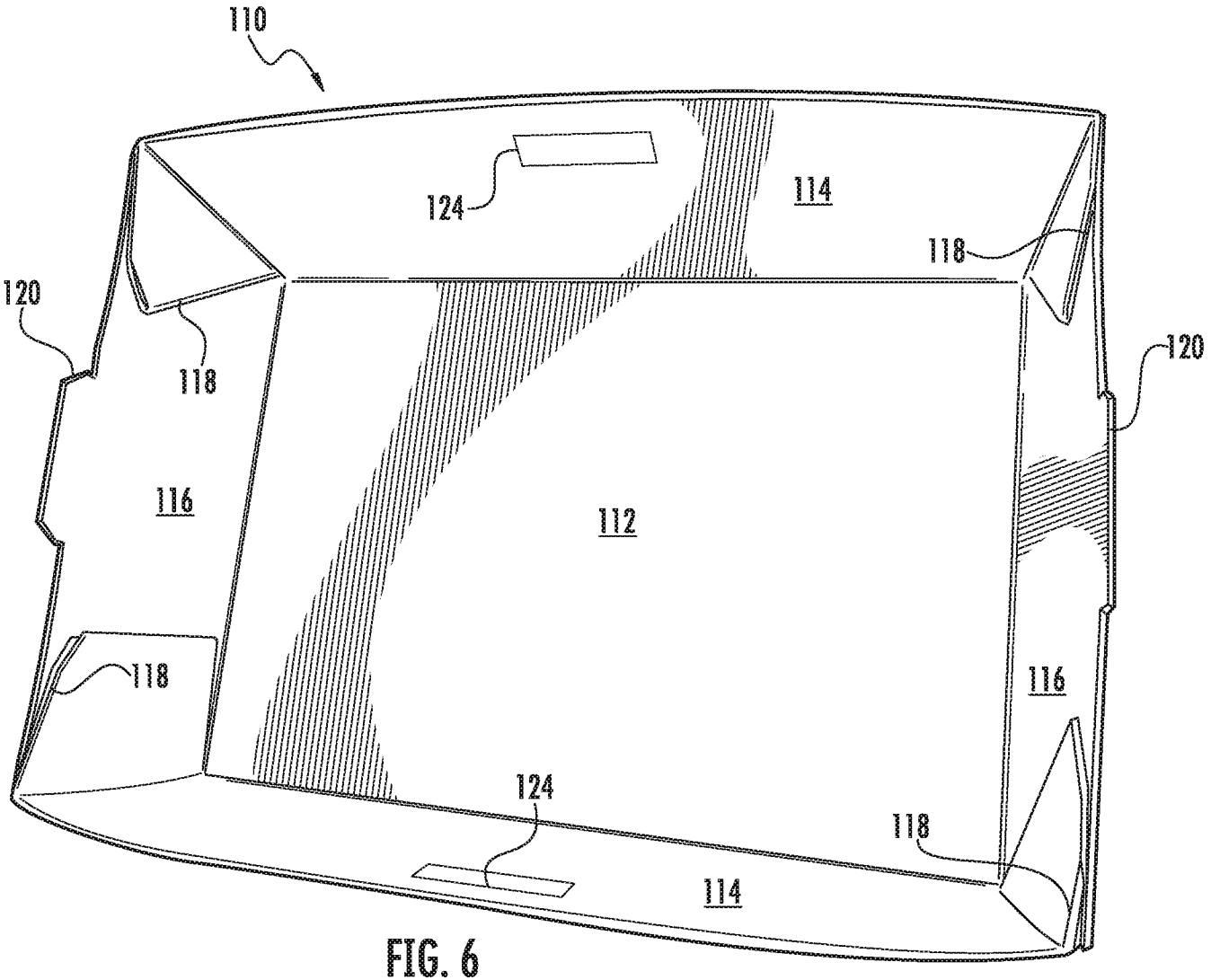
Figure 7:
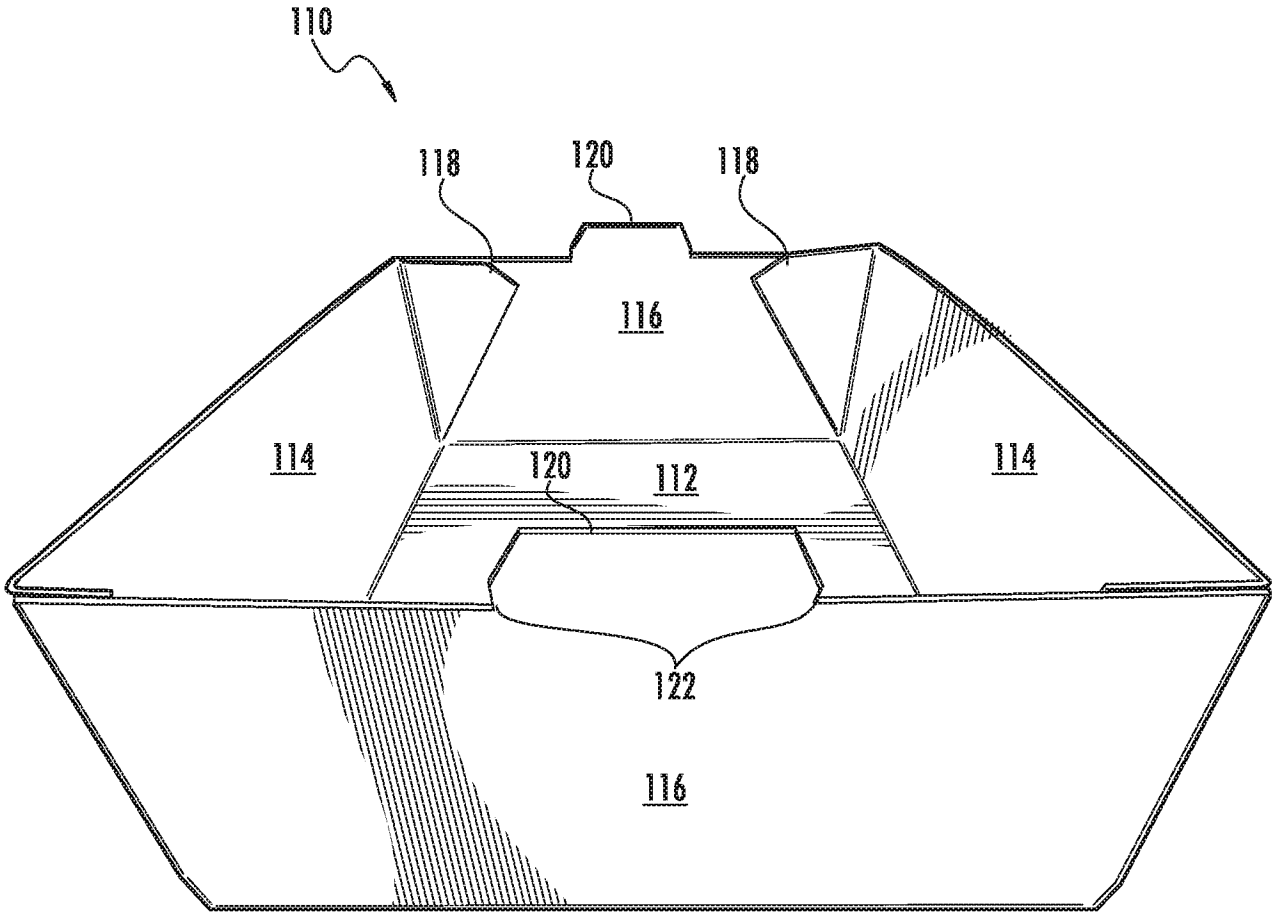
Figure 8:
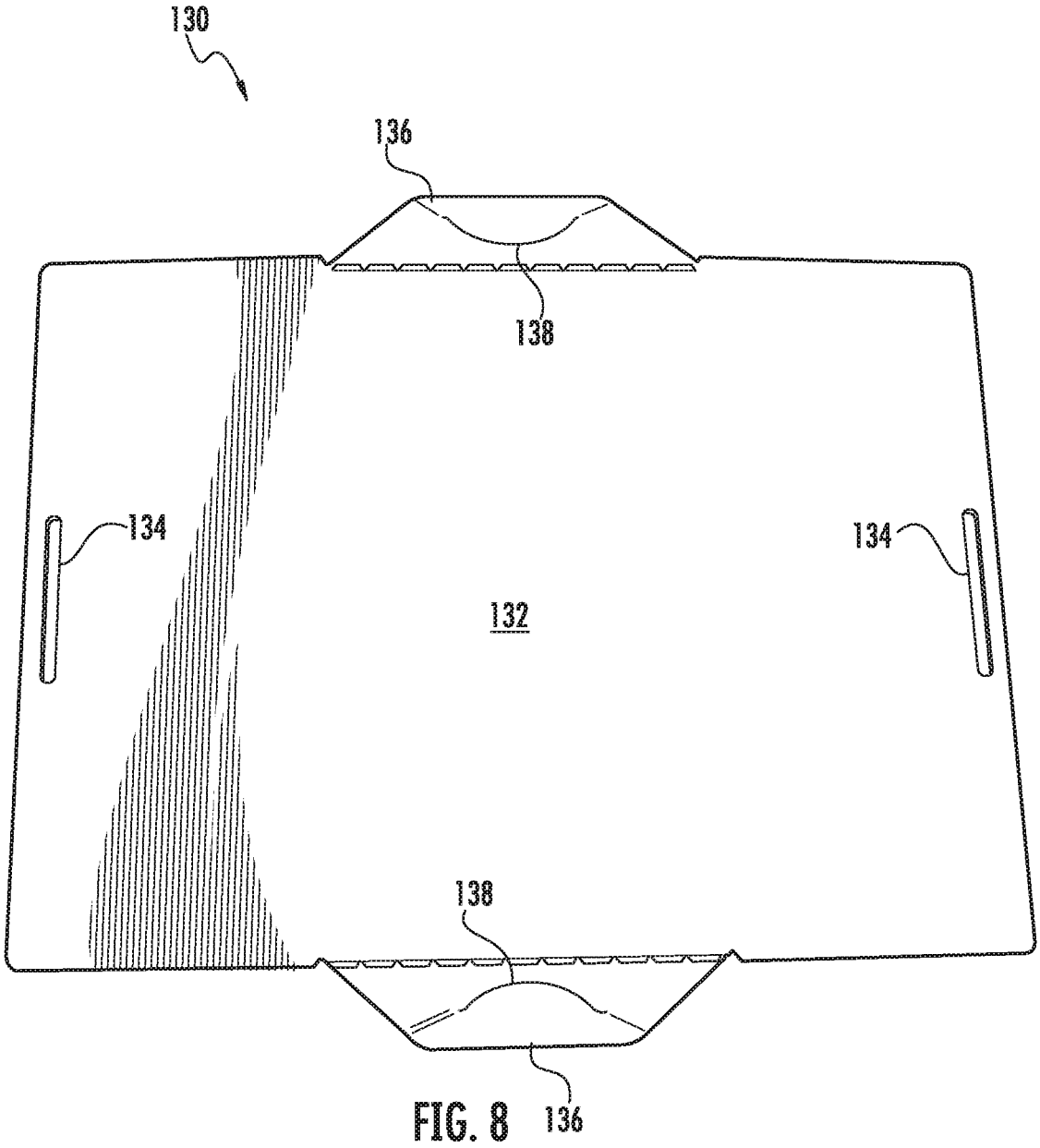
Figure 9:
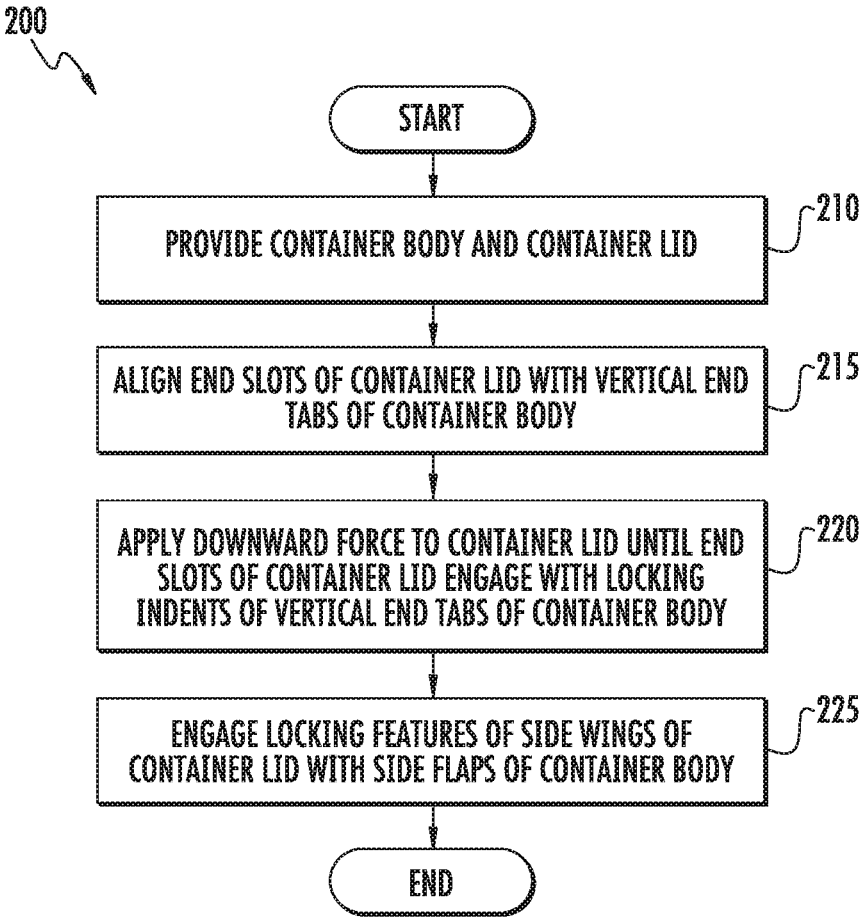

Having thus described the presently disclosed subject matter in general terms, reference will now be made to the accompanying Drawings, which are not necessarily drawn to scale, and wherein:

FIG. 1 illustrates an example of a carton with a removable lid according to an embodiment of the inventive subject matter;

FIG. 2 illustrates an example of the carton of FIG. 1 with the lid removed;

FIG. 3, FIG. 4, and FIG. 5 illustrates various views of the carton of FIG. 1;

FIG. 6 and FIG. 7 illustrates various views of the carton of FIG. 1 with the lid removed;

FIG. 8 illustrates an example of a carton lid of the carton shown in FIG. 1;

FIG. 9 illustrates a flow diagram of an example of a method of using the carton with a removable lid according to an embodiment of the inventive subject matter.

Figure 10:
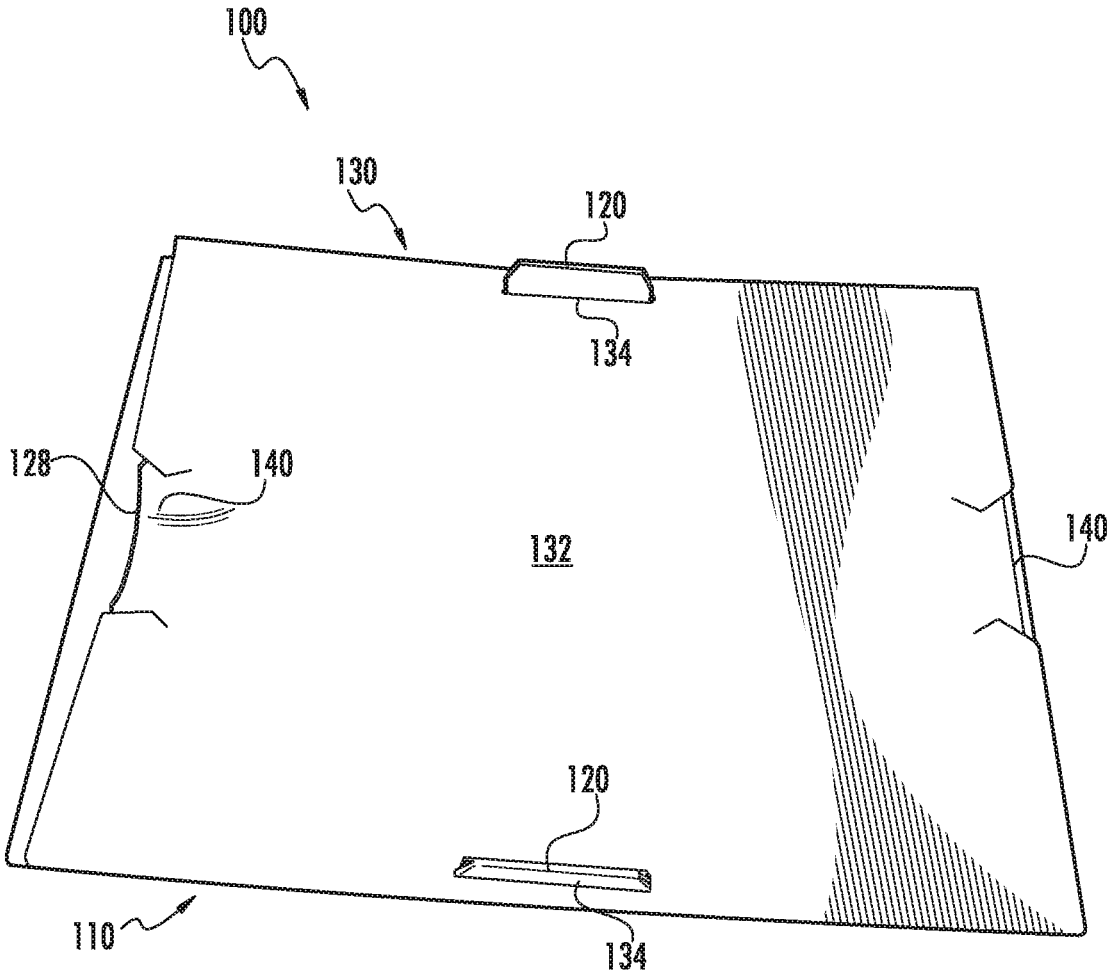
Figure 11:
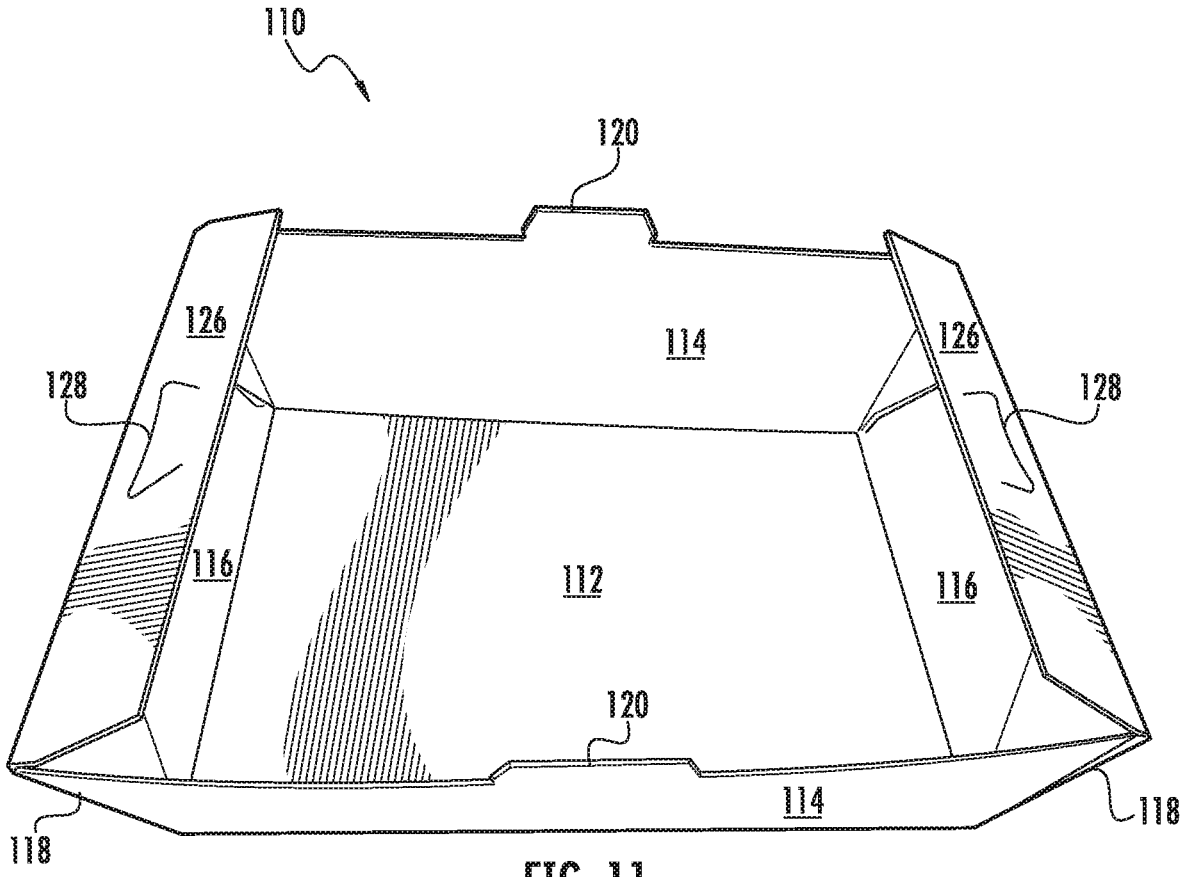
Figure 12:
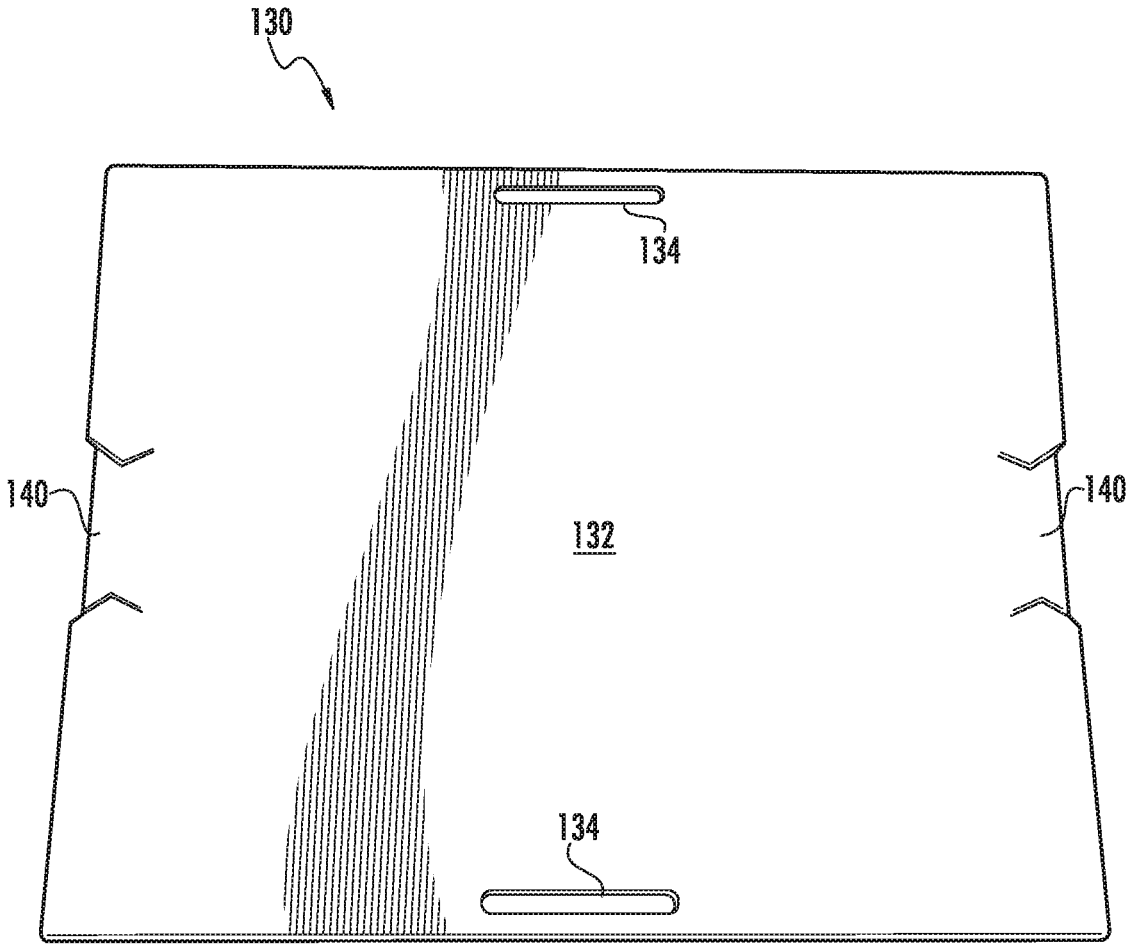
Figure 13:
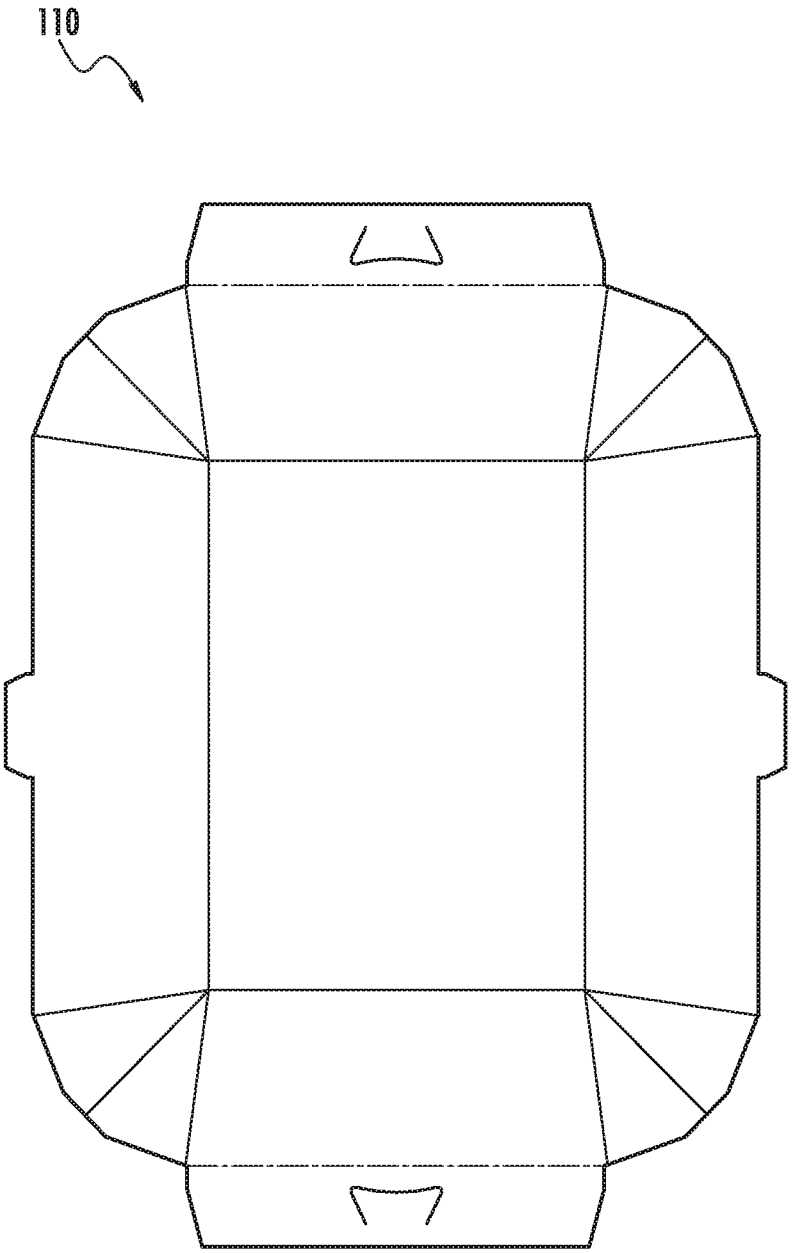
Figure 14:
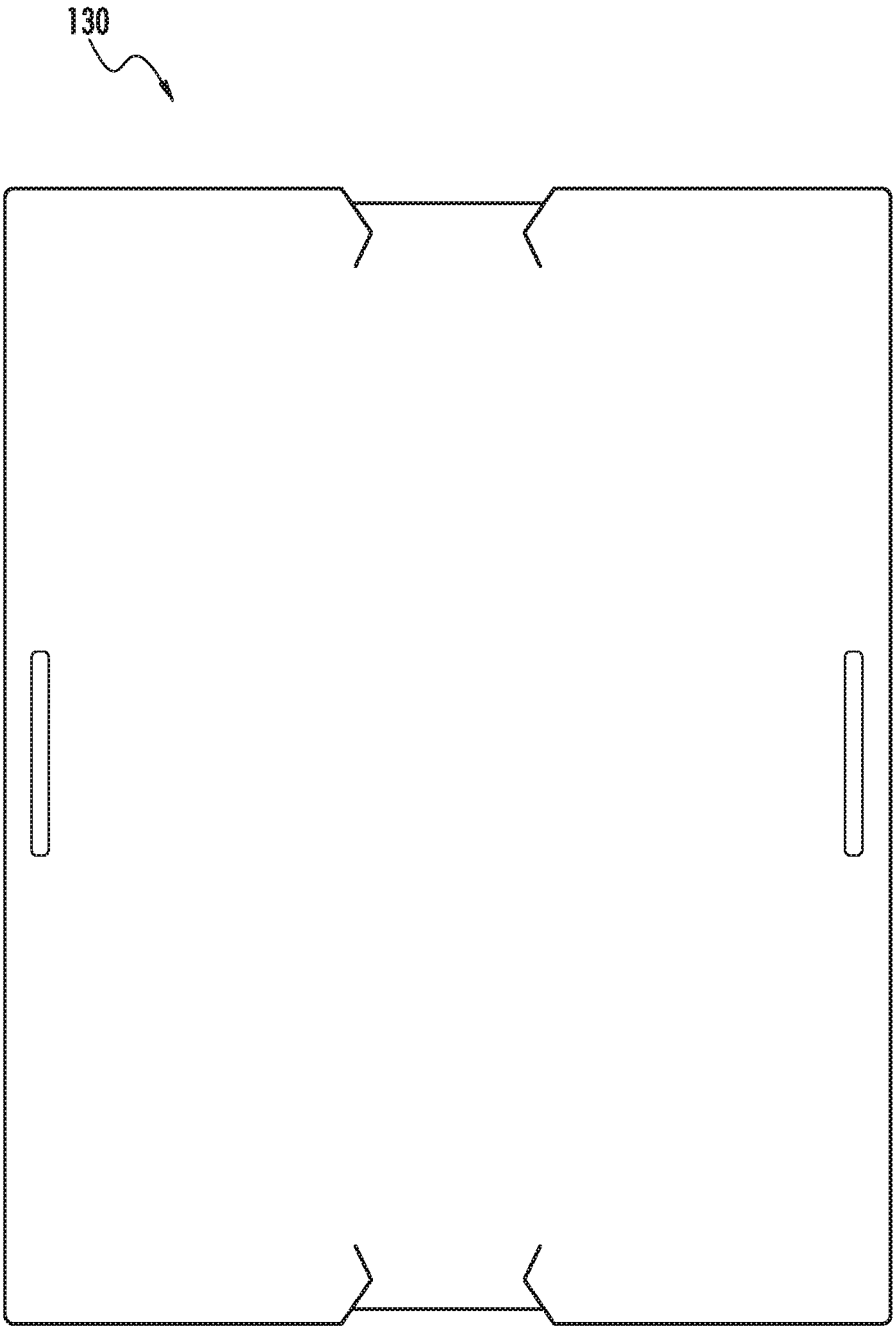
Figure 15:
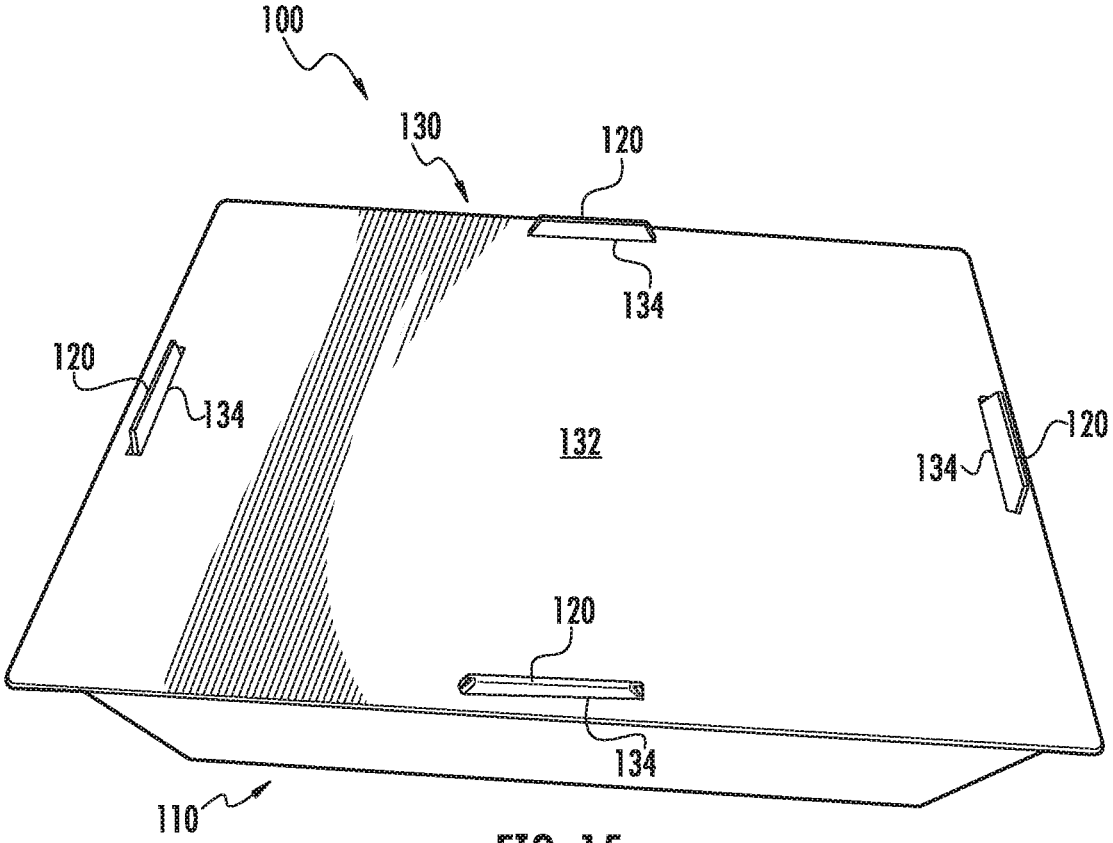
Figure 16:
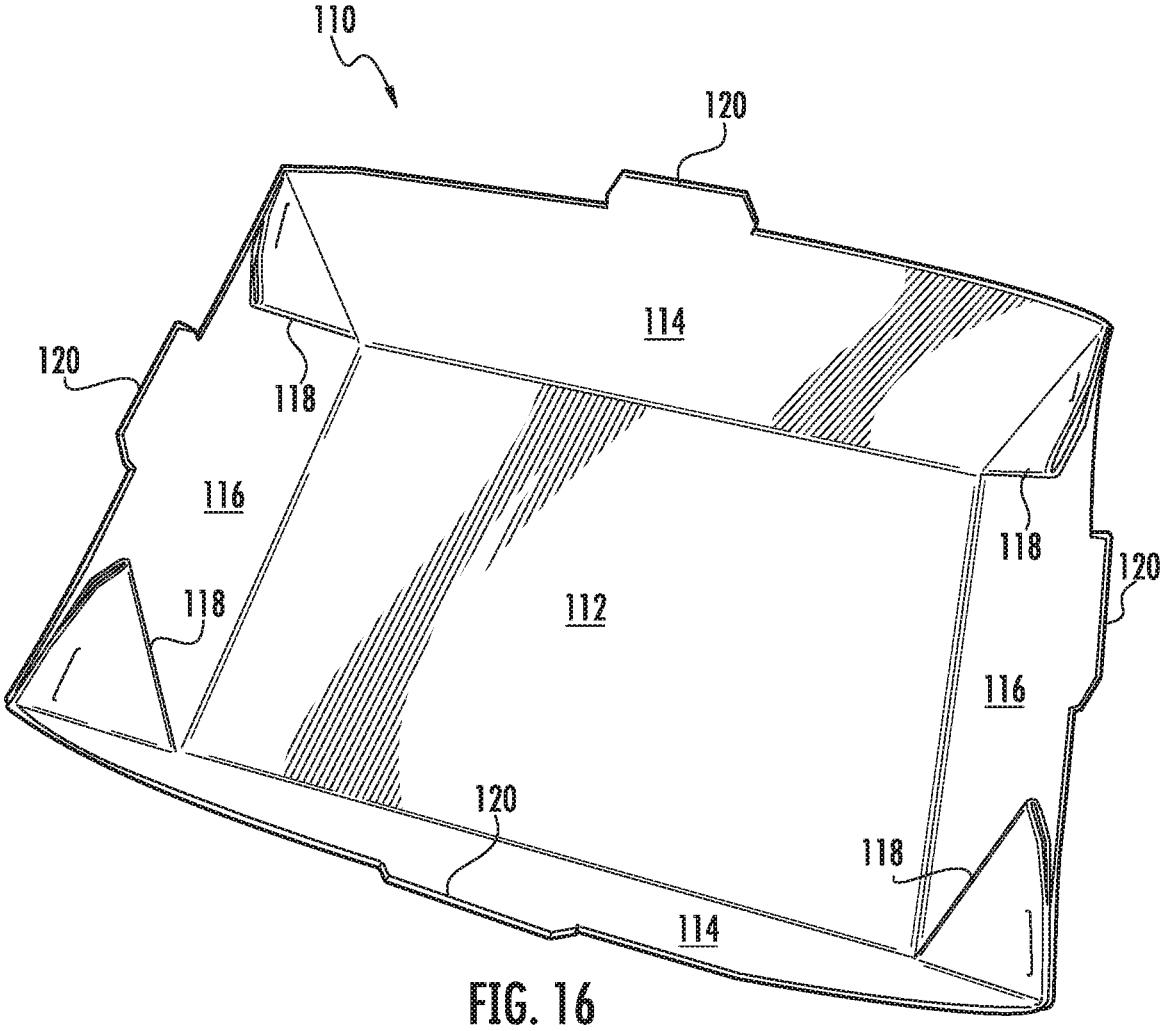
Figure 17:
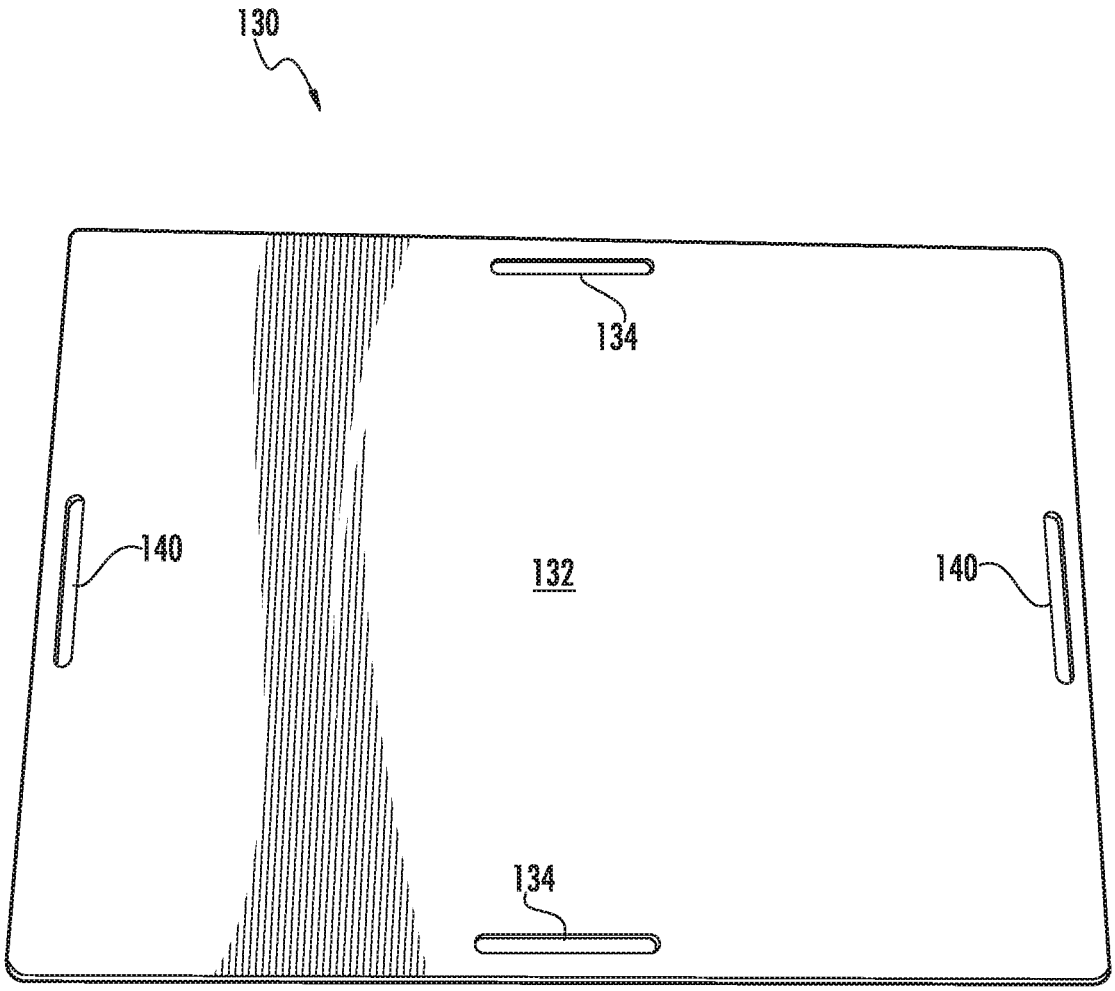
Figure 18:
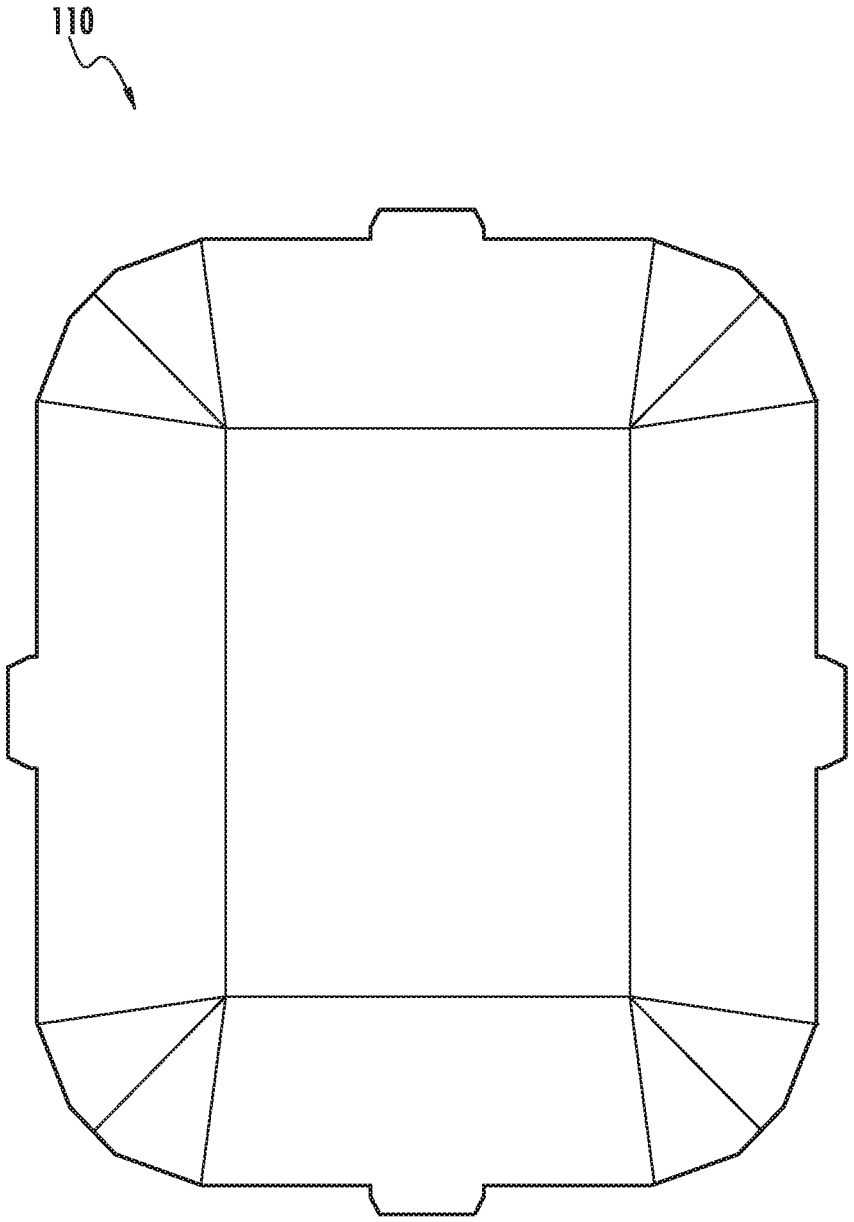
Figure 19:
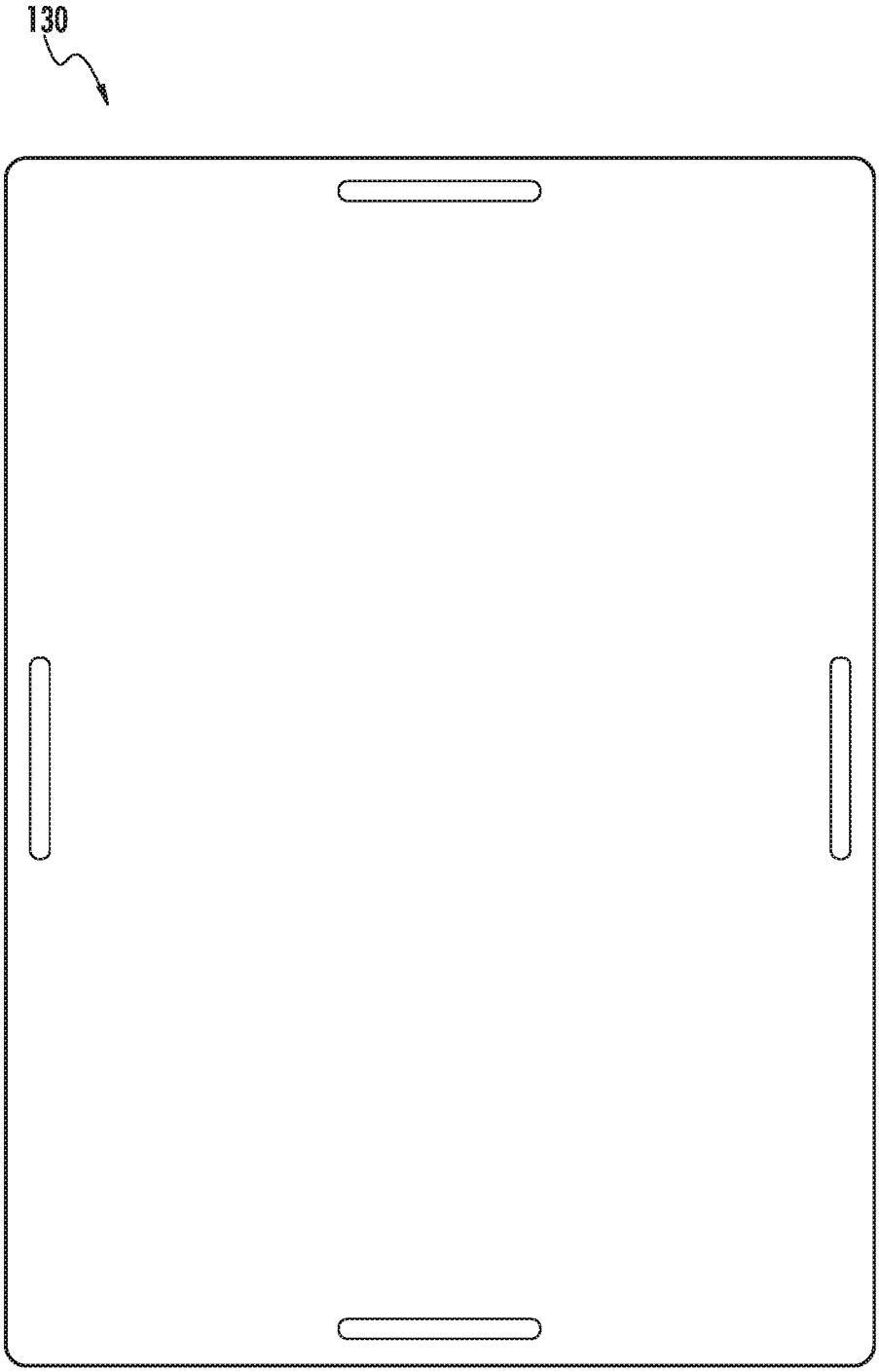
Figure 20:
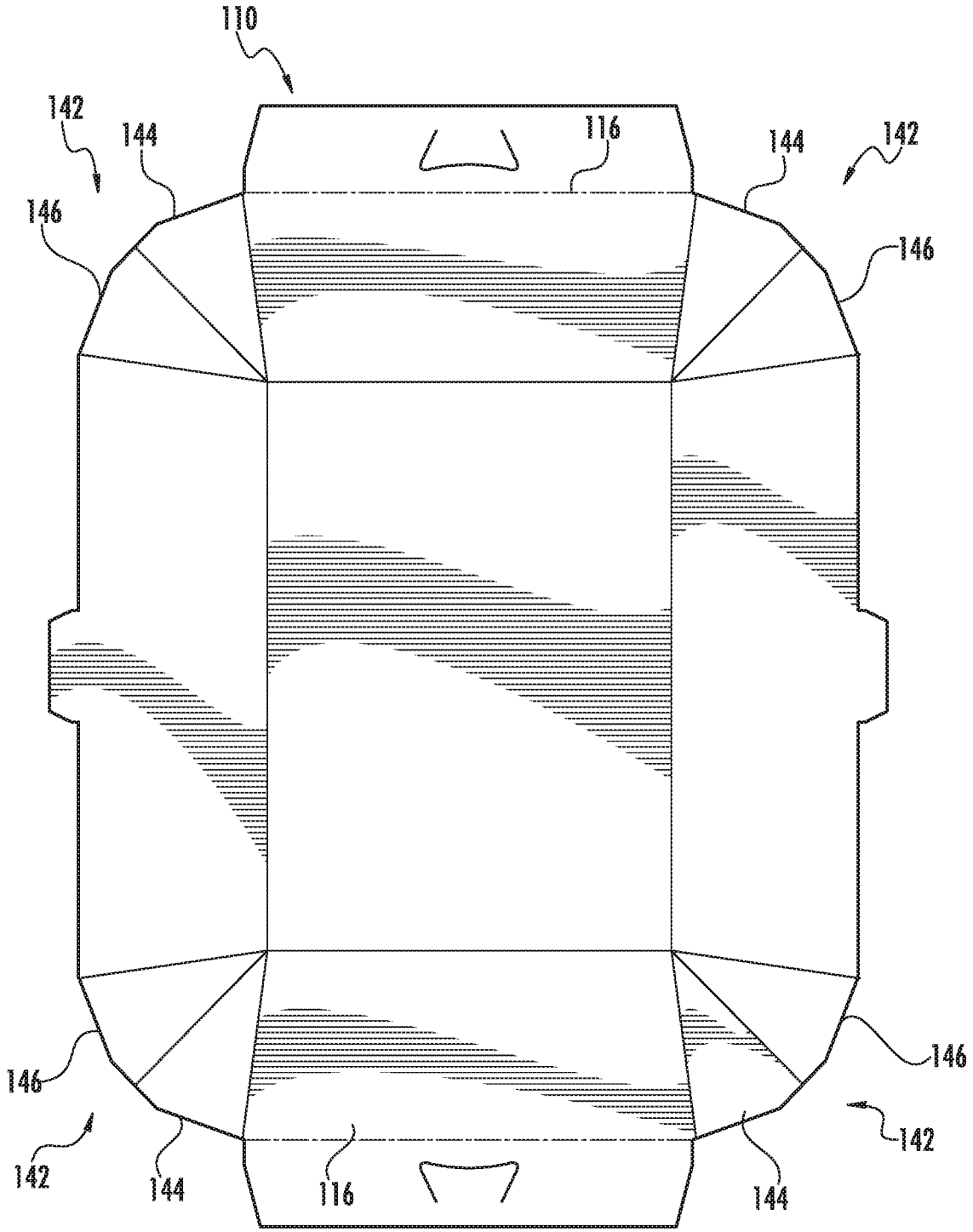
Figure 21:
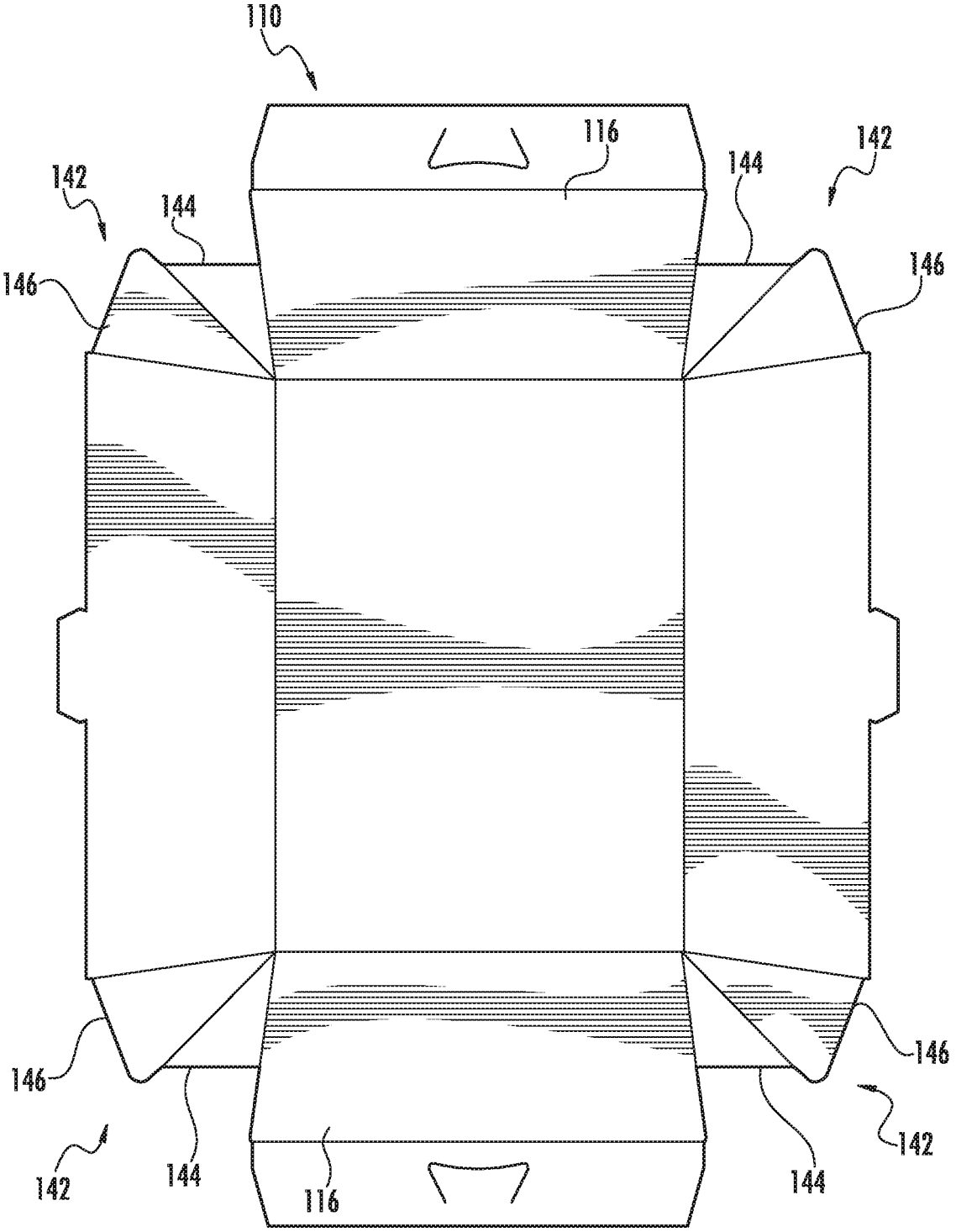
Figure 22:
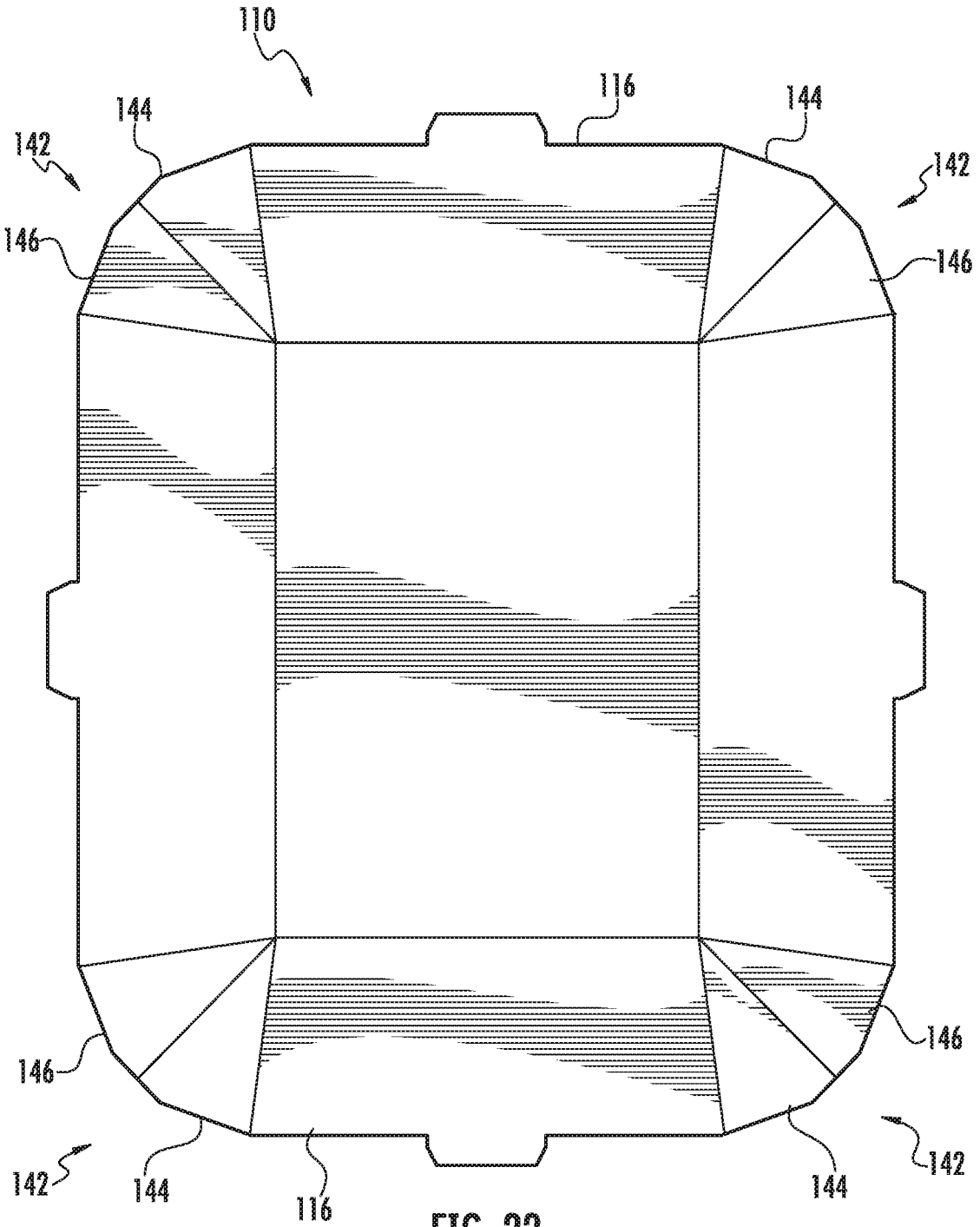
Figure 23:
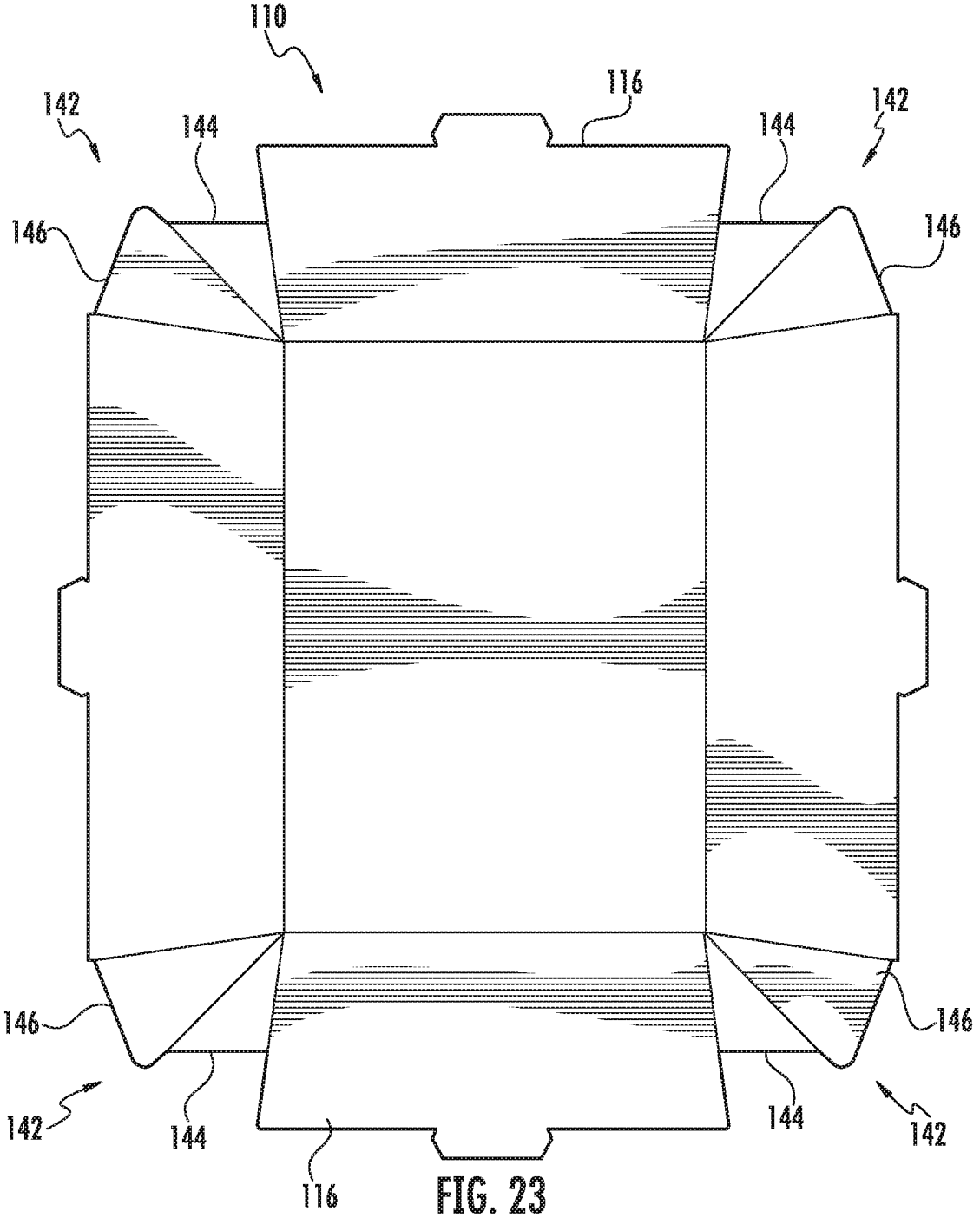
Figure 24:
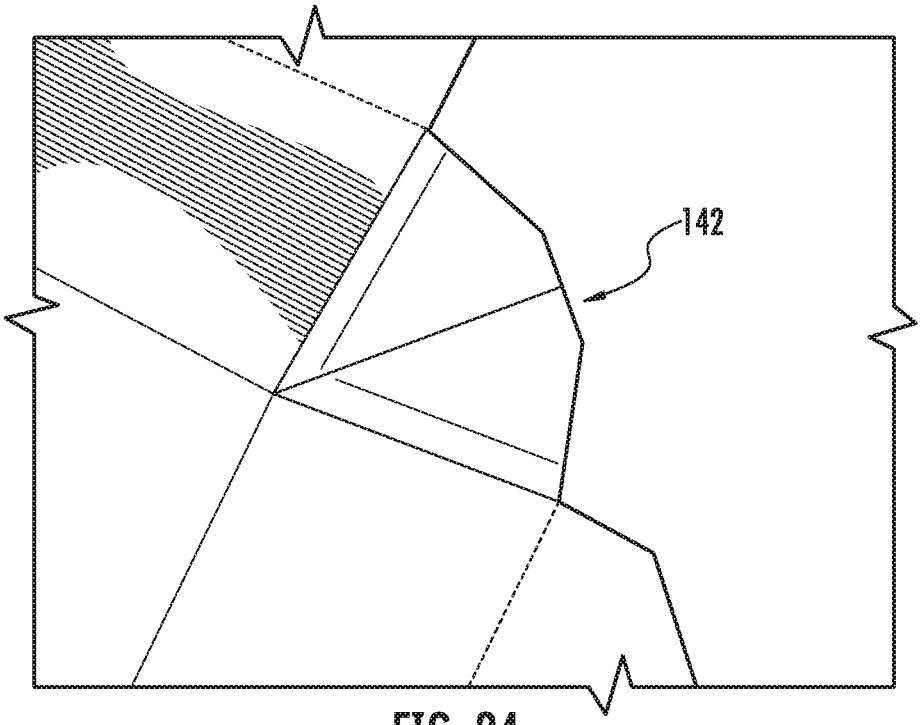
Figure 25:
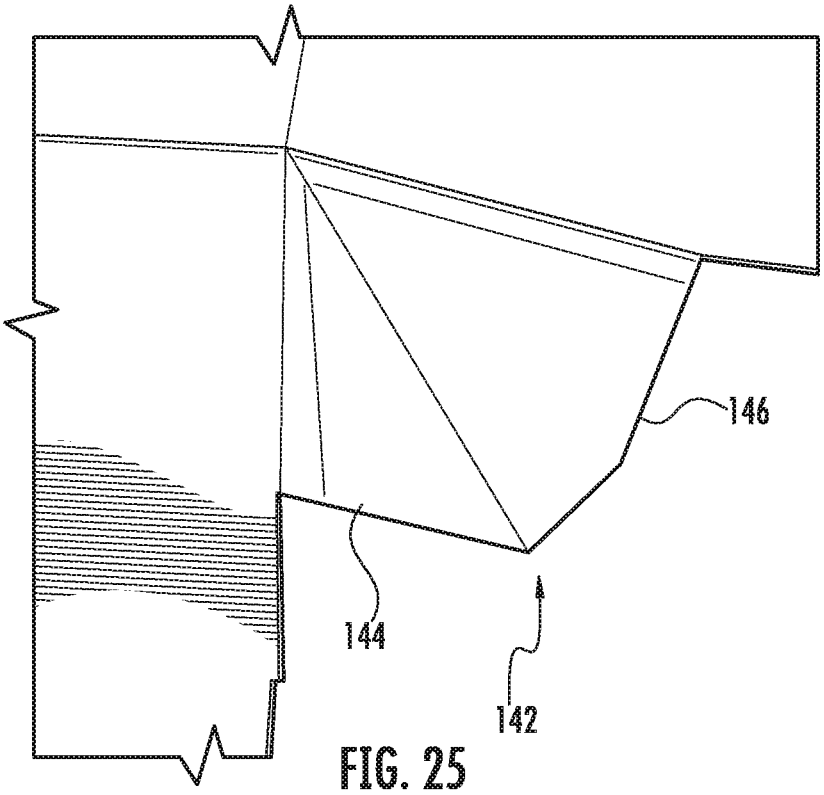
Figure 26:
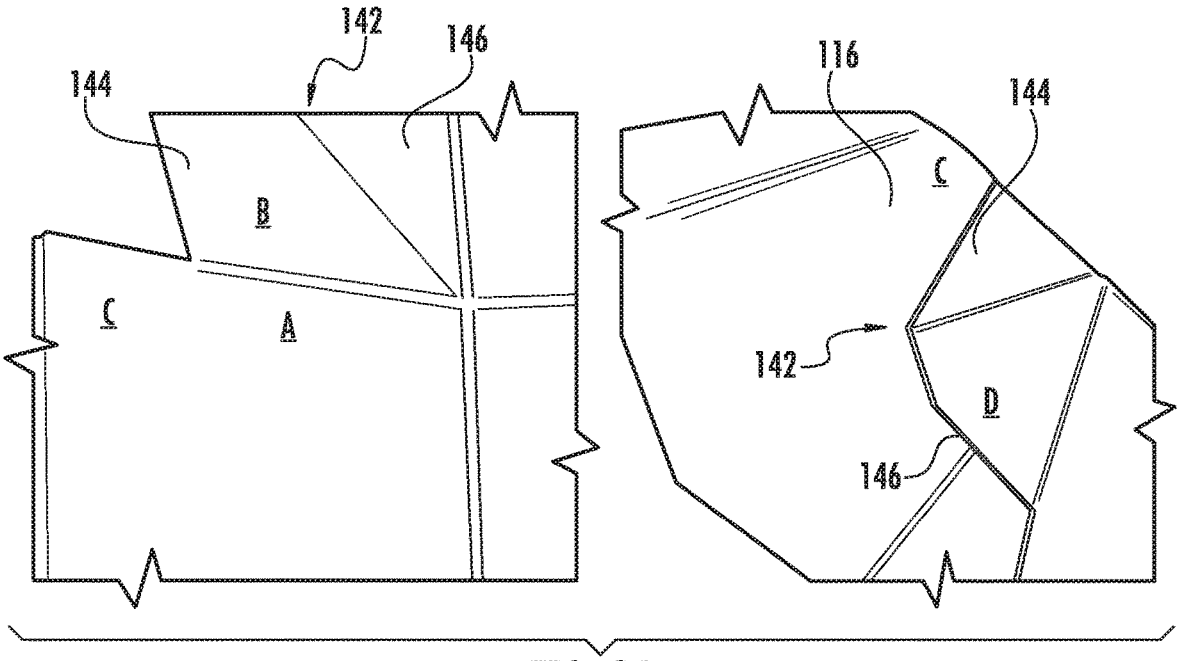
Figure 27:
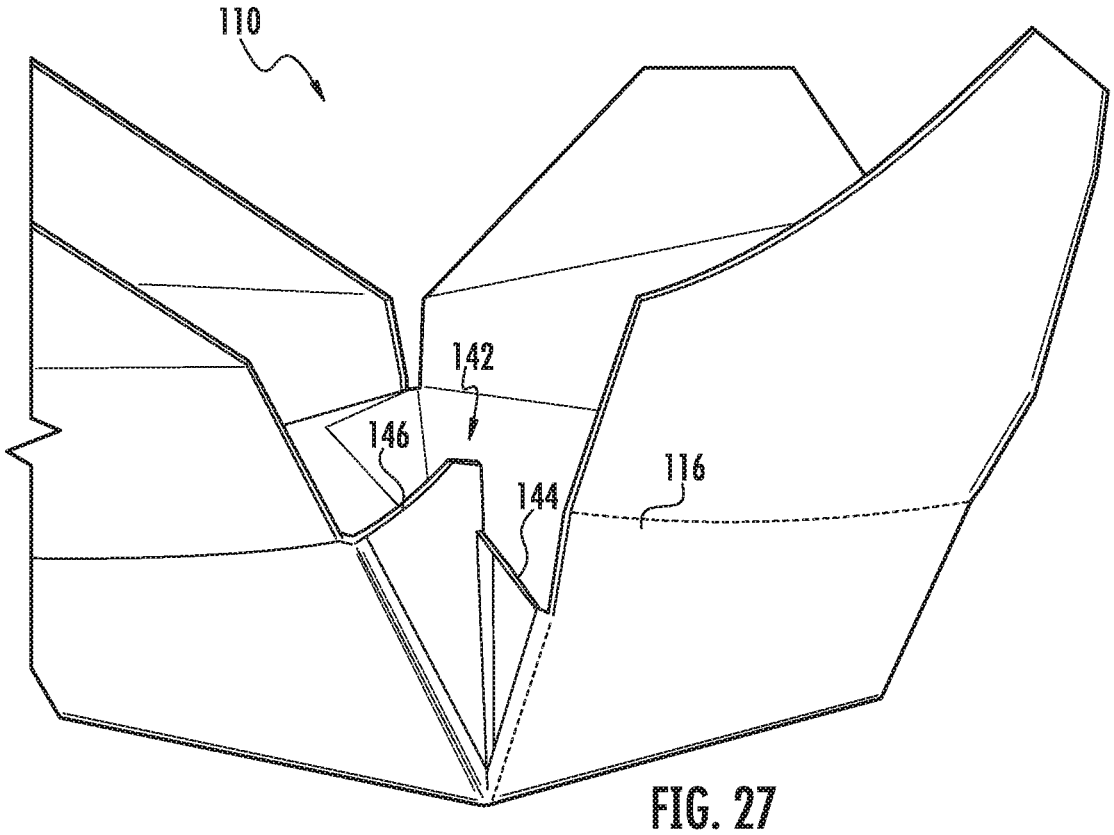
Figure 28:
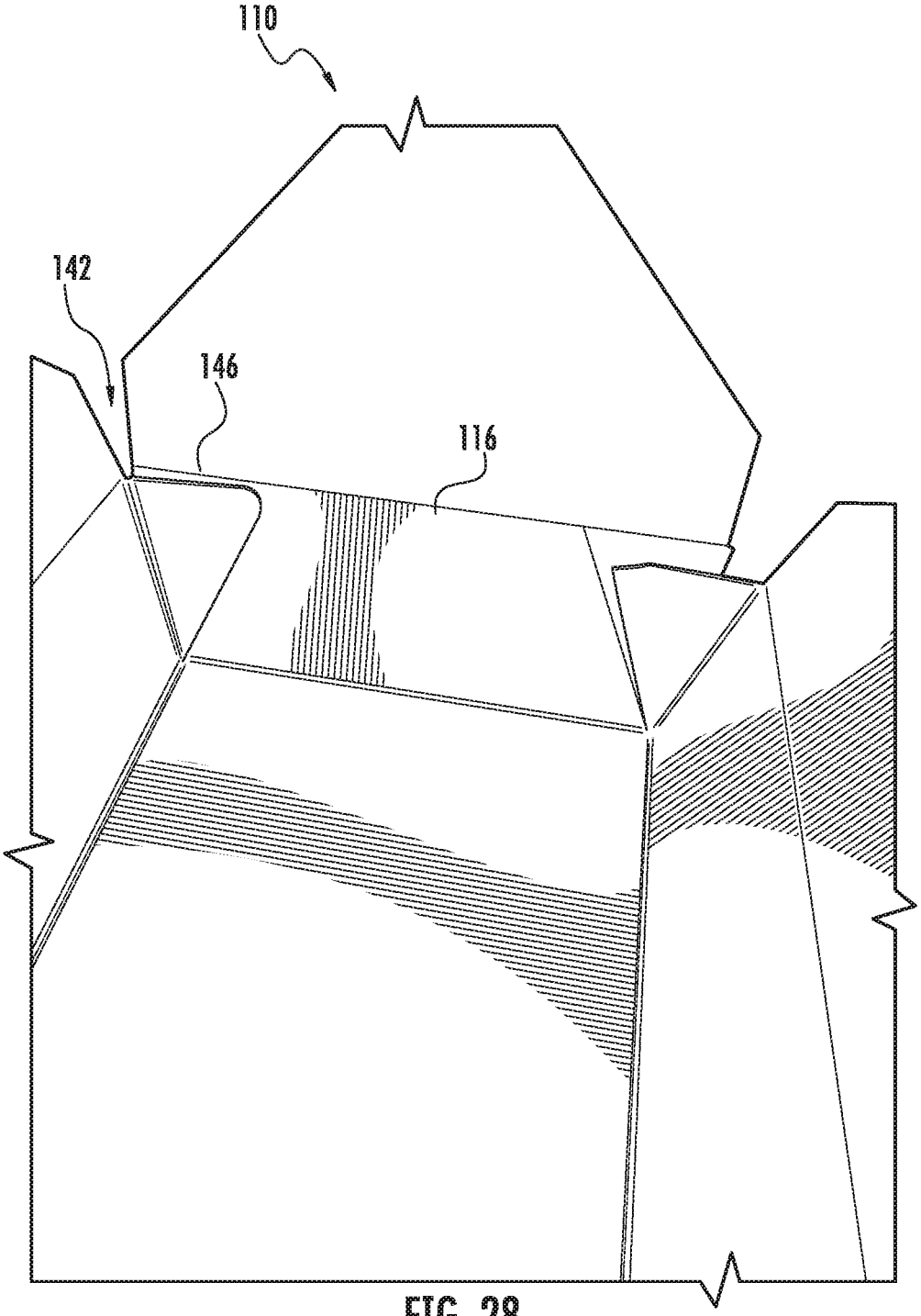

FIG. 10 illustrates another example of a carton with a removable lid according to an embodiment of the inventive subject matter;

FIG. 11 illustrates an example of the carton shown in FIG. 10 with the lid removed;

FIG. 12 illustrates an example of the carton lid of the carton shown in FIG. 10;

FIG. 13 illustrates an example of the carton body shown in FIG. 11 in an unfolded flat state;

FIG. 14 illustrates an example of the carton lid shown in FIG. 12;

FIG. 15 illustrates another example of a carton with a removable lid according to an embodiment of the inventive subject matter;

FIG. 16 illustrates an example of the carton shown in FIG. 15 with the lid removed;

FIG. 17 illustrates an example of the carton lid of the carton shown in FIG. 15;

FIG. 18 illustrates an example of the carton body shown in FIG. 16 in an unfolded flat state;

FIG. 19 illustrates an example of the carton lid shown in FIG. 17;

FIGS. 20 and 22 illustrate additional examples of the carton body shown in FIGS. 13 and 18 respectively, in an unfolded flat state;

FIGS. 21 and 23 illustrate additional examples of the carton body in an unfolded flat state;

FIG. 24 illustrates a portion of the carton body wherein first and second side portions of its foldable webbed corner are symmetrical;

FIG. 25 illustrates a portion of the carton body wherein the first side portion of its foldable webbed corner is cut back to be shorter than the second side portion;

FIG. 26 illustrates a portion of carton body 110 labeled to illustrate an example sequence for folding and sealing the foldable webbed corner shown in FIG. 25; and FIGS. 27 and 28 illustrates additional examples of the carton body.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a carton, such as a disposable carton, with a removable lid and method of using same. Namely, the presently disclosed carton includes a carton body and a separate substantially flat removable carton lid. In one example, the presently disclosed carton can be a used as a disposable food carry-out carton.

In some embodiments, the carton body includes tabs that project upward and the carton lid includes slots, wherein the slots of the carton lid engage with the upward facing tabs of the carton body. More specifically, the slots of the carton lid engage with locking indents of the upward facing tabs of the carton body and the upward facing tabs project through the removable carton lid when installed.

In a food carry-out application, being able to completely remove the lid of the presently disclosed carton allows for easy loading of the carton and also allows for easily eating directly out of the carton. Further, the flat lid allows for easy stacking of multiple of the presently disclosed cartons. Further, the upward facing tabs that project through the removable carton lid may be useful to prevent stacked cartons from slipping off one another.

Additionally, a method of using the presently disclosed carton is provided.

In some embodiments, the carton body includes a heat sealing coating, wherein the carton body can be folded into its assembled state and the corner flaps folded and heat sealed to an inside surface of the assembled carton body without adding any glue, thereby providing a fully compostable carton.

Referring now to FIG. 1 through FIG. 8 illustrate various views of an example of carton 100 that has a removable lid and that can be a used, for example, as a disposable food carry-out (or take-out) carton that is openable and closable. Namely, FIG. 1 shows the carton 100 with the removable lid installed; FIG. 2 shows the carton 100 with the lid removed; FIG. 3, FIG. 4, and FIG. 5 also show the carton 100 with the removable lid installed; FIG. 6 and FIG. 7 show a carton body of the carton 100; and FIG. 8 shows a carton lid of the carton.

The carton 100 includes a carton body 110 and a separate carton lid 130. The carton body 110 further includes a floor panel 112, two opposing side panels 114, and two opposing end panels 116. The ends of the side panels 114 and the end panels 116 are coupled via corner folds 118. The corner folds 118 can be, for example, a web corner inside glue design. The corner folds 118 can be secured, for example, via an adhesive, thermal bonding, or any other suitable technique or mechanism. Vertical end tabs 120 are provided at the end panels 116. For example, one vertical end tab 120 extends upwardly from one end panel 116 of the carton body 110. Another vertical end tab 120 extends upwardly from the other end panel 116 of the carton body 110. Further, locking indents 122 are provided at the base of each of the vertical end tabs 120, as shown in FIG. 7. Additionally, a side flap 124 may be integrated into each of the side panels 114 of the carton body 110. Accordingly, there may be two side flaps 124.

The carton lid 130 is a substantially flat and removable carton lid. The carton lid 130 includes a lid panel 132, a pair of end slots 134 (i.e., one at each end), and a pair of side wings (or ears or tabs) 136 (i.e., one at each side). Further, each of the side wings 136 may include a locking feature 138.

The carton body 110 and the carton lid 130 of the carton 100 can be formed of any lightweight, rigid or semi-rigid material that is suitable for holding and/or transporting, for example, a quantity of food and that is also suitable for disposing of after use. For example, the carton 100 can be formed of corrugated cardboard, paper, paperboard, post-consumer paperboard (i.e., recycled materials), biodegradable materials (e.g., sugarcane and paper), polystyrene foam (e.g., Styrofoam), plastic, molded fiber, and the like.

In operation, a user aligns the end slots 134 of the carton lid 130 with the vertical end tabs 120 of the carton body 110. Then, the user pushes down on each end of the carton lid 130 until the end slots 134 engage the locking indents 122 of the vertical end tabs 120 of the carton body 110. Then, the user folds down the side wings 136 of the carton lid 130. Then, the user slightly bends the side wings 136 of the carton lid 130 such that the locking feature 138 are directed inward and toward the side flaps 124 of the carton body 110. At the same time, the user pushes the locking feature 138 inward slightly such that the side flaps 124 are depressed inward slightly and the locking feature 138 engage with an edge, slit, or slot now formed in the side panels 114 by the open side flaps 124.

Referring now to FIG. 9 is a flow diagram of an example of a method 200 of using the presently disclosed carton 100. The method 200 may include, but is not limited to, the following steps.

At a step, 210, the carton body 110 and the carton lid 130 are provided and a user may place, for example, a quantity of food into the carton body 110.

At a step, 215, the end slots 134 of the carton lid 130 are aligned with the vertical end tabs 120 of the carton body 110.

At a step, 220, downward force is applied to the ends of the carton lid 130 until the end slots 134 of the carton lid 130 engage with the locking indents 122 of the vertical end tabs 120 of the carton body 110.

At a step, 225, the locking feature 138 of the side wings 136 of the carton lid 130 are engaged with the side flaps 124 in the side panels 114 of the carton body 110. For example, the user folds down the side wings 136 of the carton lid 130. Then, the user slightly bends the side wings 136 of the carton lid 130 such that the locking feature 138 can engage with an edge, slit, or slot formed in the side panels 114 by the slightly open side flaps 124.

In a food carry-out application, being able to completely remove the carton lid 130 of the presently disclosed carton 100 allows for easy loading of the carton 100 and also allows for easily eating directly out of the carton 100. Further, the flat carton lid 130 allows for easy stacking of multiple of the presently disclosed cartons 100. Further, the vertical end tabs 120 of the carton body 110 that project upward through the end slots 134 of the removable carton lid 130 may be useful to prevent cartons 100 that are stacked from slipping off one another. Namely, the vertical end tabs 120 provide "stop" features on the upper surface of the carton 100.

Referring now to FIG. 10, FIG. 11, and FIG. 12 illustrate additional views of an example carton 100 that has a removable lid and that can be a used, for example, as a disposable food carry-out (or take-out) carton that is openable and closable. Namely, FIG. 10 shows this example of the carton 100 with the carton lid 130 installed atop the carton body 110; FIG. 11 shows the carton body 110 of the carton 100; and FIG. 12 shows the carton lid 130 of the carton 100.

The carton 100 shown in FIG. 10, FIG. 11, and FIG. 12 is substantially the same as the carton 100 shown in FIG. 1 through FIG. 8 except for a different configuration of fastening features between the carton body 110 and the carton lid 130.

For example and referring now to FIG. 11, in this embodiment the carton body 110 may include side tabs 120 instead of end tabs 120. Further, the side flaps 124 may be omitted from the carton body 110. The carton body 110 further may include end flaps 126. Each of the end flaps may include an end tab 128. Referring now to FIG. 12, the carton lid 130 may include the lid panel 132, a pair of side slots 134 (e.g., one at each side) instead of the end slots 134, and a pair of end flaps 140 (e.g., one at each side).

In operation and referring now to FIG. 10, the side slots 134 of the carton lid 130 may engage with the side tabs 120 of the carton body 110. At the same time, the end flaps 140 of the carton lid 130 may engage with the end tabs 128 of the end flaps 126 of the carton body 110.

Referring now to FIG. 13 is a plan view of an example of a pattern for forming the carton body 110 shown in FIG. 11. Namely, FIG. 13 shows non-limiting example dimensions of the carton body 110 and its features. Further, FIG. 13 shows example fold lines of the carton body 110. Similarly, FIG. 14 shows a plan view of an example of a pattern for forming the carton lid 130 shown in FIG. 12. Namely, FIG. 14 shows non-limiting example dimensions of the carton lid 130 and its features.

Referring now to FIG. 15, FIG. 16, and FIG. 17 are photos showing various views of yet another example of the presently disclosed carton 100 that has a removable lid and that can be a used, for example, as a disposable food carry-out (or take-out) carton that is openable and closable. Namely, FIG. 15 shows this example of the carton 100 with the carton lid 130 installed atop the carton body 110; FIG. 16 shows the carton body 110 of the carton 100; and FIG. 17 shows the carton lid 130 of the carton 100.

The carton 100 shown in FIG. 15, FIG. 16, and FIG. 17 is substantially the same as the carton 100 shown in FIG. 1 through FIG. 8 except for a different configuration of fastening features between the carton body 110 and the carton lid 130.

For example and referring now to FIG. 16, in this embodiment the carton body 110 may include both the side tabs 120 and the end tabs 120. Further, the side flaps 124 may be omitted from the carton body 110. Referring now to FIG. 17, the carton lid 130 may include the lid panel 132, and both the side slots 134 (e.g., one at each side) and the end slots 134 (e.g., one at each side).

In operation and referring now to FIG. 15, the side slots 134 of the carton lid 130 may engage with the side tabs 120 of the carton body 110. At the same time, the end slots 134 of the carton lid 130 may engage with the end tabs 120 of the carton body 110.

Referring now to FIG. 18 is a plan view of an example of a pattern for forming the carton body 110 shown in FIG. 16. Namely, FIG. 18 shows non-limiting example dimensions of the carton body 110 and its features. Further, FIG. 18 shows example fold lines of the carton body 110. Similarly, FIG. 19 shows a plan view of an example of a pattern for forming the carton lid 130 shown in FIG. 17. Namely, FIG. 19 shows non-limiting example dimensions of the carton lid 130 and its features.

Referring now to FIGS. 20 and 22 are additional plan views of the pattern of FIGS. 13 and 18 respectively. FIGS. 20 and 22 show carton body 110 having substantially symmetrical webbed corners 142, including a first side portion 144 that is substantially the same size and shape as its adjacent second side portion 146. To assemble carton body 110 from a pattern shown in either of FIG. 20 or 22, webbed corners 142 are folded inward at a fold line at the intersection of the first side portion 144 and second side portion 146. Glue or other adhesive is applied inside the fold such that the outside facing surfaces of the first side portion 144 and second side portion 146, when folded together, are adhered together. The inside facing surface of the first side portion 144 may be adhered to or otherwise bonded to a portion of the inside surface of its adjacent end panel 116. Alternatively, the inside facing surface of the second side portion 146 may be adhered to or otherwise bonded to a portion of the inside surface of its adjacent side panel 114. Adhering, or otherwise bonding, the inside facing surface of the first side portion 144 to the inside surface of its adjacent end panel 116, may include adding an amount of glue or other type of adhesive between the inside surface of the end panel 116 and the inside facing surface of its adjacent first side portion 144, and folding the inside facing surface of the first side portion 144 such that it contacts the inside surface of its adjacent end panel 116. This may be repeated for all four corners of the carton body 110, or done for two (2) or more corners simultaneously. In the example, where the second side portion is adhered to its adjacent side panel 114, adhering, or otherwise bonding, the inside facing surface of the second side portion 146 to the inside surface of its adjacent side panel 114, would be done in a similar manner.

Alternatively, the inside surface of the carton body 110 may be coated with a heat sealable coating, and instead of applying glue or other adhesive between the inside surface of the end panel 116 and the inside facing surface of its adjacent first side portion 144, once the inside facing surface of the first side portion 144 is folded to be in contact with the inside surface of its adjacent end panel 116 it may be heat sealed by applying heat to the folded area and causing the heat sealable coating present on the interior surface of the carton body 110, to bond the inside facing surface of the first side portion 144 to the inside surface of its adjacent end panel 116. Heat sealing the second side portion 146 to its adjacent side panel 114, would be done in a similar manner. Again, this may be repeated for all four corners of the carton body 110, or done for two (2) or more corners simultaneously.

Referring now to FIGS. 21 and 23 are plan views of additional examples of patterns for forming the carton body 110. FIGS. 21 and 23 show carton body 110 having webbed corners 142, wherein a first side portion 144 of the webbed corner 142 is cut back, such that it is shorter than its adjacent second side portion 146. In this embodiment, the inside surface of carton body 110 may be coated with a heat sealing coating. When carton body 110 is assembled, the second side portion 146 folds over and overlaps first side portion 144, and a top portion of the second side portion 146 extends past the upper most edge of the first side portion 144. The top portion of the second side portion 146 that extends past the upper most edge of first side portion 144, when webbed corner 142 is in a folded configuration, may be heat sealed directly to an interior surface of an end panel 116 (e.g., to the interior surface of the end panel 116 adjacent to first side portion 144) of the carton body 110. When the second side portion 146 is folded over the first side portion 144 and heat sealed to the interior of end panel 116 it functions to hold the first side portion 144 in its folded state and to the interior surface of end panel 116 without requiring any glue or other adhesive. To assemble carton body 110 from a pattern shown in either of FIG. 21 or 23, the cut back first side portion 144 of webbed corner 142 is folded over such that its inside facing surface is in contact with the inside facing surface of its adjacent side panel 116. The first side portion 144 is then heat sealed in place to its adjacent side panel 116. Second side portion is then folded along a fold line at the intersection of first side portion 144 and second side portion 146, such that the outside facing surface of second side portion 146 overlaps the outside surface of first side portion 144. In this folded position, the top portion of second side portion 146 that extends above the top edge of the cut back first side portion is in contact with the inside surface of the same side panel 116 that the first side portion is heat sealed to. The top portion of the side portion 146 that is in contact with the inside surface of the side panel 116 is then heat sealed in place. This may be repeated for all four corners of the carton body 110, or done for two (2) or more corners simultaneously. Alternatively, second side portion 146 may be the cut back corner side portion, and webbed corner 142 is folded and heat sealed to the inside surface of the side panel 114 of its respective adjacent second side portion 146 in a similar manner as detailed above with regard to the embodiment where the first side portion 144 is the cut back corner side portion.

FIG. 24 shows an example photograph of a webbed corner 142 having symmetrical first side portion 144 and second side portion 146.

FIG. 25 shows an example portion of carton body 110 wherein the first side portion 144 of its webbed corner 142 is cut back to be shorter than the second side portion 146.

FIG. 26 shows an example portion of carton body 110 labeled to illustrate the sequence for folding and sealing the webbed corner 142 shown in FIG. 25.

FIGS. 27 and 28 show an example carton body 110 having uneven (cut back) webbed corners 142 as shown, for example, in FIGS. 21 and 23. FIG. 27 shows an example uneven (cut back) webbed corner 142 in an unsealed (unassembled) state. FIG. 28 shows an example uneven (cut back) webbed corner 142 in a sealed (assembled) state.

By cutting back part of the first side portion 144 or second side portion 146 of webbed corners 142 and having the inside surface of carton body 110 coated with a heat sealing coating, the carton body 110 can be folded into its assembled state and webbed corners 142 can be heat sealed in place without using any glue, so that assembled carton 100 is a fully compostable carton.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A carton, comprising:

a. a floor panel;

b. a plurality of side panels extending about a periphery of the floor panel, wherein one or more of the side panels comprise one or more tabs extending from an upper edge thereof;

c. foldable corner gussets extending between adjacent side panels, the foldable corner gussets each comprise a first side portion and an adjacent second side portion, wherein the first side portion and the second side portions intersect at a fold line therebetween, and wherein the floor panel, side panels, and foldable corner gussets are configurable to form a compartment region; and d. a removable lid, comprising a lid panel and one or more slots formed in the lid panel, wherein the lid panel is configured to cover the compartment region, and wherein the one or more slots are sized, shaped, and positioned such that when the removable lid is installed atop the compartment region, the one or more tabs align with the one or more slots and are received therethrough.

2. The carton of claim 1, wherein the plurality of side panels comprise two opposing end panels and two opposing side panels, wherein adjacent side panels and end panels are coupled together via foldable corner gussets.

3. The carton of claim 2, wherein each of the opposing end panels or each of the opposing side panels comprise one or more tabs.

4. The carton of claim 2, wherein each of the opposing end panels and each of the opposing side panels comprise one or more tabs.

5. The carton of claim 1, wherein the one or more tabs comprise locking indents formed at their base, wherein when the removable lid is installed atop the compartment region the locking indents are configured to engage with the one or more slots to hold the removable lid in place.

6. The carton of claim 1, wherein the removable lid comprises one or more side wings formed on one or more side edges of the lid panel.

7. The carton of claim 6, wherein the one or more side wings are formed on the one or more side edges of the lid panel that do not comprise one of the one or more slots.

8. The carton of claim 6, wherein one or more of the side panels further comprise a side flap formed therein.

9. The carton of claim 8, wherein the side flap is formed on the one or more side panels that do not comprise one of the one or more tabs.

10. The carton of claim 8, wherein the one or more side wings each comprise a locking mechanism, wherein the locking mechanism is configured to engage with a corresponding side flap of a corresponding side panel when the removable lid is installed atop the compartment region.

11. The carton of claim 6, wherein the lid panel comprises two opposing side edges and two opposing end edges, wherein the one or more slots are formed proximate to the opposing end edges and the one or more side wings extend from the opposing side edges.

12. The carton of claim 11, wherein the lid panel comprises one slot formed proximate to each of the opposing end edges and one side wing extending from each of the opposing side edges.

13. The carton of claim 1, wherein the one or more tabs are spaced and configured such that when the removable lid is installed atop the compartment region a bottom surface of a compartment region of a second carton can nestle between the one or more tabs such that the bottom surface of the compartment region of the second carton sits substantially flat atop a top surface of the removable lid.

14. The carton of claim 1, wherein the removable lid comprises one or more flaps formed on one or more side edges of the lid panel.

15. The carton of claim 14, wherein one or more of the side panels further comprise an inward folding side flap.

16. The carton of claim 15, wherein the inward folding side flap comprises a tab formed therein, wherein the tab is configured to engage with a portion of a corresponding flap of the lid panel when the removable lid is installed atop the compartment region.

17. The carton of claim 1, wherein the foldable corner gussets are configured to be folded inward along their respective fold lines such that exterior facing surfaces of adjacent first and second side portions are in contact with one another.

18. The carton of claim 17, wherein the inward folded foldable corner gussets are configured to be further folded such that an interior facing surface of one of the first or second side portions is in contact with an interior surface of its corresponding adjacent side panel.

19. The carton of claim 17, further comprising an adhesive, wherein the adhesive holds the exterior facing surfaces of the adjacent first and second side portions in contact with one another.

20. The carton of claim 17, wherein the first side portion and the second side portion are substantially the same size and shape.

21. The carton of claim 17, wherein one of the first side portion or the second side portion is shorter than the other one.

22. The carton of claim 21, wherein the inward folded foldable corner gussets are configured to be further folded such that an interior facing surface of the shorter one of the first or second side portions is in contact with an interior surface of its corresponding adjacent side panel.

23. The carton of claim 22, wherein the interior surface of the compartment region comprises a heat sealable coating, and wherein the foldable corner gussets is secured in its fully folded configuration by activating the heat sealable coating using a heat sources.

24. The carton of claim 1, wherein the interior surface of the compartment region comprises a heat sealable coating.

* * * * *